US010022857B2

(12) United States Patent
Kao

(10) Patent No.: US 10,022,857 B2
(45) Date of Patent: Jul. 17, 2018

(54) HAND TOOL FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 15/487,645

(22) Filed: Apr. 14, 2017

(65) Prior Publication Data

US 2017/0259425 A1 Sep. 14, 2017

Related U.S. Application Data

(63) Continuation-in-part of application No. 15/067,740, filed on Mar. 11, 2016, now Pat. No. 9,694,491.

(51) Int. Cl.
*B25H 3/04* (2006.01)
*B25H 3/00* (2006.01)

(52) U.S. Cl.
CPC ..... *B25H 3/04* (2013.01); *B25H 3/003* (2013.01)

(58) Field of Classification Search
CPC . B25H 3/04; B25H 3/003; B25H 3/00; B25H 3/006; B25H 5/00
See application file for complete search history.

(56) References Cited

U.S. PATENT DOCUMENTS 4,826,021 A * 5/1989 Burrell ..... B25B 13/56 211/70.6
5,228,570 A * 7/1993 Robinson ..... B25B 13/56 206/375
5,645,177 A * 7/1997 Lin ..... B25H 3/04 206/378
6,105,794 A * 8/2000 Bauer ..... A47B 57/26 108/108
6,431,373 B1 8/2002 Blick
6,637,605 B2 * 10/2003 Ernst ..... B25H 3/003 206/378
7,152,747 B2 12/2006 Wang
7,198,158 B2 * 4/2007 Kao ..... A47F 5/083 211/70.6
7,798,339 B2 * 9/2010 Brooks ..... G11B 33/02 211/103
7,841,480 B2 * 11/2010 Hsieh ..... B25H 3/06 206/378
8,042,892 B2 * 10/2011 Benz ..... A47B 57/562 108/108
8,302,786 B2 11/2012 Kao
8,403,155 B1 3/2013 Kao
8,479,929 B1 7/2013 Kao
9,205,553 B2 12/2015 Ou
(Continued)

*Primary Examiner* — Ko H Chan
(74) *Attorney, Agent, or Firm* — Alan D. Kamrath; Kamrath IP Lawfirm, P.A.

(57) ABSTRACT

A hand tool frame has a track base, at least one positioning mount, and an engaging structure. The track base has a bottom panel, a slide rail, and a connecting track. The at least one positioning mount is slidably mounted on the track base, and each has a sliding seat and an extending element. The sliding seat is slidably mounted in the slide rail and abuts the bottom panel. The extending element is formed on the sliding seat and extends out of the slide rail. The engaging structure is formed between the bottom panel of the track base and the at least one positioning mount to enable the at least one positioning mount to position securely on the track base without sliding relative to the track base, and has at least one first engaging segment and a second engaging segment.

13 Claims, 26 Drawing Sheets

(56) References Cited

U.S. PATENT DOCUMENTS

| | | | | |
|---|---|---|---|---|
| 9,527,206 | B1 * | 12/2016 | Hsieh | B25H 3/04 |
| 9,694,491 | B1 | 7/2017 | Kao | |
| 2002/0121491 | A1 | 9/2002 | Ernst | |
| 2006/0118499 | A1 | 6/2006 | Kao | |
| 2009/0090644 | A1 | 4/2009 | Kao | |
| 2009/0194494 | A1 | 8/2009 | Kao | |
| 2010/0001159 | A1 | 1/2010 | Kao | |
| 2010/0065520 | A1 * | 3/2010 | Hsieh | B25H 3/06 211/70.6 |
| 2013/0062480 | A1 * | 3/2013 | Kao | B25H 3/04 248/201 |

* cited by examiner

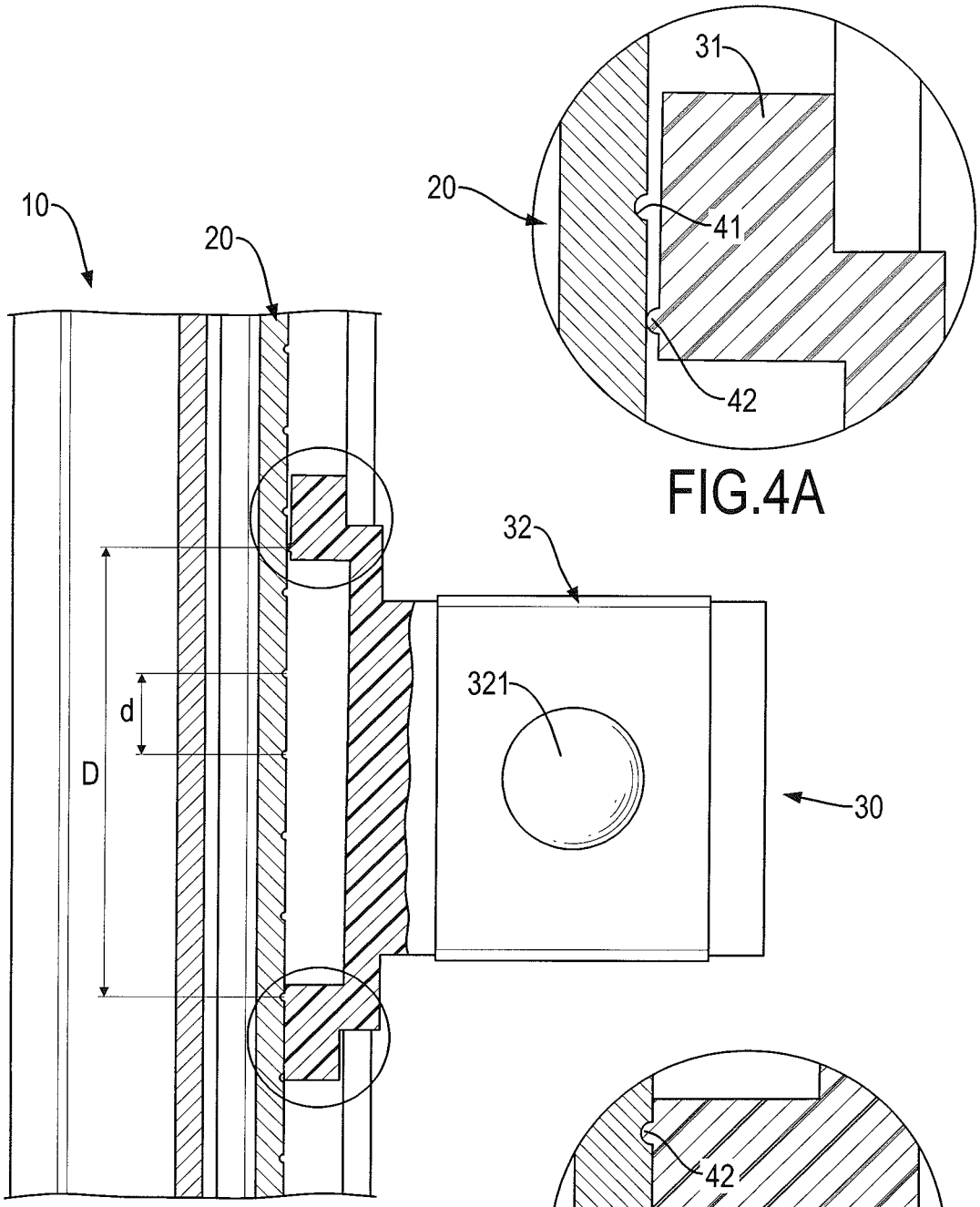
FIG.4
FIG.4A
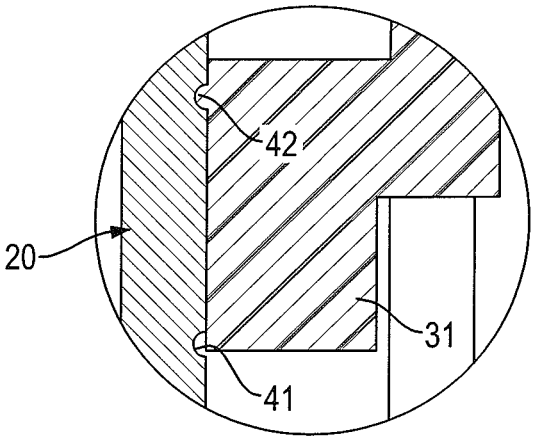
FIG.4B

HAND TOOL FRAME

The present invention is a continuation-in-part of application Ser. No. 15/067,740, filed on Mar. 11, 2016.

BACKGROUND OF THE INVENTION

1. Field of the Invention

The present invention relates to a hand tool frame and, more particularly, to a hand tool frame that may provide a positioning effect to hand tools that are mounted on the hand tool frame and may improve the practicality of the hand tool frame.

2. Description of Related Art

With reference to FIG. 24, a conventional hand tool frame 80 has a track base 81 and multiple positioning mounts 82. The track base 81 is an elongated seat and has a front side and a slide rail 811. The slide rail 811 is formed in the front side of the track base 81. The positioning mounts 82 are slidably mounted in the slide rail 811 of the track base 81. Then, hand tools such as sleeves, wrenches or screwdrivers may be securely mounted on the positioning mounts 82 to store the hand tools on the track base 81 of the conventional hand tool frame 80.

Furthermore, when the conventional hand tool frame 80 is used to store sleeves, each one of the positioning mounts 82 has a sliding seat 821 and an inserting button 822. The sliding seat 821 is round and is slidably mounted in the slide rail 811 of the track base 81 and has a front surface. The inserting button 822 is rectangular, is formed on and protrudes from the front surface of the sliding seat 821 and extends out of the slide rail 811. In use, a sleeve 90 is mounted around the inserting button 822 of one of the positioning mounts 82 without rotating relative to inserting button 822 of the positioning mount 82 since the inserting button 822 is rectangular. The user needs to rotate the round sliding seat 821 of the positioning mount 82 relative to the slide rail 811 to allow the sleeve 90 to rotate to enable a number or sign on the sleeve 90 to face the user. After rotating the sliding seats 821 of the positioning mounts 82 relative to the track base 81, the sleeves 90 that are mounted around the inserting buttons 822 of the positioning mounts 82 may be adjusted to enable numbers or signs on the sleeves 90 to face a same direction for the user.

Though the conventional hand tool frame 80 may provide a rotation adjustment effect to the sleeves, the sliding seats 821 of the positioning mounts 82 lack engaging structures relative to the slide rail 811 of the track base 81 to hold the sleeves 90 securely on the track base 81 at specific positions. When a sleeve 90 of a large size is mounted around an upper positioning mount 82, the upper positioning mount 82 may slide downwardly along the slide rail 811 due to the weight of the sleeve 90 of a large size and also because the track base 81 is disposed longitudinally. Then, the sleeve 90 of a large size and the upper positioning mount 82 may knock against a lower positioning mount 82, and the positioning mounts 82 may gather at a bottom of the track base 81. This may hinder the user from clearly observing and distinguishing the sizes of the sleeves by the numbers or signs.

Furthermore, when the user wants to take a sleeve 90 of a small size that is mounted on a lower positioning mount 82, the upper positioning mount 82 may slide downwardly with the large size sleeve 90 to shorten a distance between the two adjacent positioning mounts 82 and knock against the lower positioning mount 82. After using the small size sleeve 90, the user needs to move the upper positioning mount 82 and the large size sleeve 90 upwardly to recover the distance between the two adjacent positioning mounts 82 to re-mount the small size sleeve 90 on the lower positioning mount 82. This is inconvenient in use and storage.

In addition, when the conventional hand tool frame is used to store wrenches or screwdrivers, and since the round sliding seats 821 of the positioning mounts 82 may rotate and slide relative to the slide rail 811 of the track base 81, the two adjacent positioning mounts cannot hold one of the wrenches or screwdrivers securely on the track base 81. This may limit the practicality of the conventional hand tool frame.

Furthermore, with reference to FIG. 25, another conventional hand tool frame 80A has a track base 81A and at least one pair of positioning mounts 82A. The track base 81A is an elongated seat and has a top side and a slide rail 811A. The slide rail 811A is formed in the top side of the track base 81A. Each one of the at least one pair of positioning mounts 82A is slidably mounted in the slide rail 811A of the track base 81A, and has a sliding seat 821A and an extending element 822A. The sliding seat 821A is slidably mounted in the slide rail 811A and has a top surface. The extending element 822A is formed on and protrudes from the top surface of the sliding seat 821A, and is a clamping arm.

Then, with reference to FIG. 26, different kinds of hand tools such as pliers 91, combination spanners 92, adjustable wrenches 93, socket wrenches 94, hexagonal wrenches 95 or screwdrivers 96 may be inserted into a holding space that is formed between the clamping arms of the at least one pair of positioning mounts 82A.

However, each one of the at least one pair of positioning mounts 82A does not engage with the track base 81A. Therefore, each one of the at least one pair of positioning mounts 82A may move relative to the track base 81A during insertion of the different kinds of hand tools. A width of the holding space between the clamping aims of the at least one pair of positioning mounts 82A may increase since the hand tools are pushing the extending elements 822A. The different kinds of hand tools may fall from the conventional tool frame 80A, which is very inconvenient in use.

To overcome the shortcomings, the present invention tends to provide a hand tool frame to mitigate the aforementioned problems.

SUMMARY OF THE INVENTION

The main objective of the invention is to provide a hand tool frame that may provide a positioning effect to hand tools that are mounted on the hand tool frame and may improve the practicality of the hand tool frame.

A hand tool frame in accordance with the present invention has a track base, at least one positioning mount, and an engaging structure. The track base has a bottom panel, a slide rail, and a connecting track. The at least one positioning mount is slidably mounted on the track base, and each has a sliding seat and an extending element. The sliding seat is slidably mounted in the slide rail and abuts the bottom panel. The extending element is formed on the sliding seat and extends out of the slide rail. The engaging structure is formed between the bottom panel of the track base and the at least one positioning mount to enable the at least one positioning mount to position securely on the positioning board without sliding relative to the track base, and has at least one first engaging segment and a second engaging segment.

Other objectives, advantages and novel features of the invention will become more apparent from the following detailed description when taken in conjunction with the accompanying drawings.

BRIEF DESCRIPTION OF THE DRAWINGS

FIG. 4 is an enlarged side view in partial section of the hand tool frame in FIG. 1;

FIGS. 4A and 4B are enlarged side views of the hand tool frame in FIG. 4;

DETAILED DESCRIPTION OF PREFERRED EMBODIMENT

Figure 1:
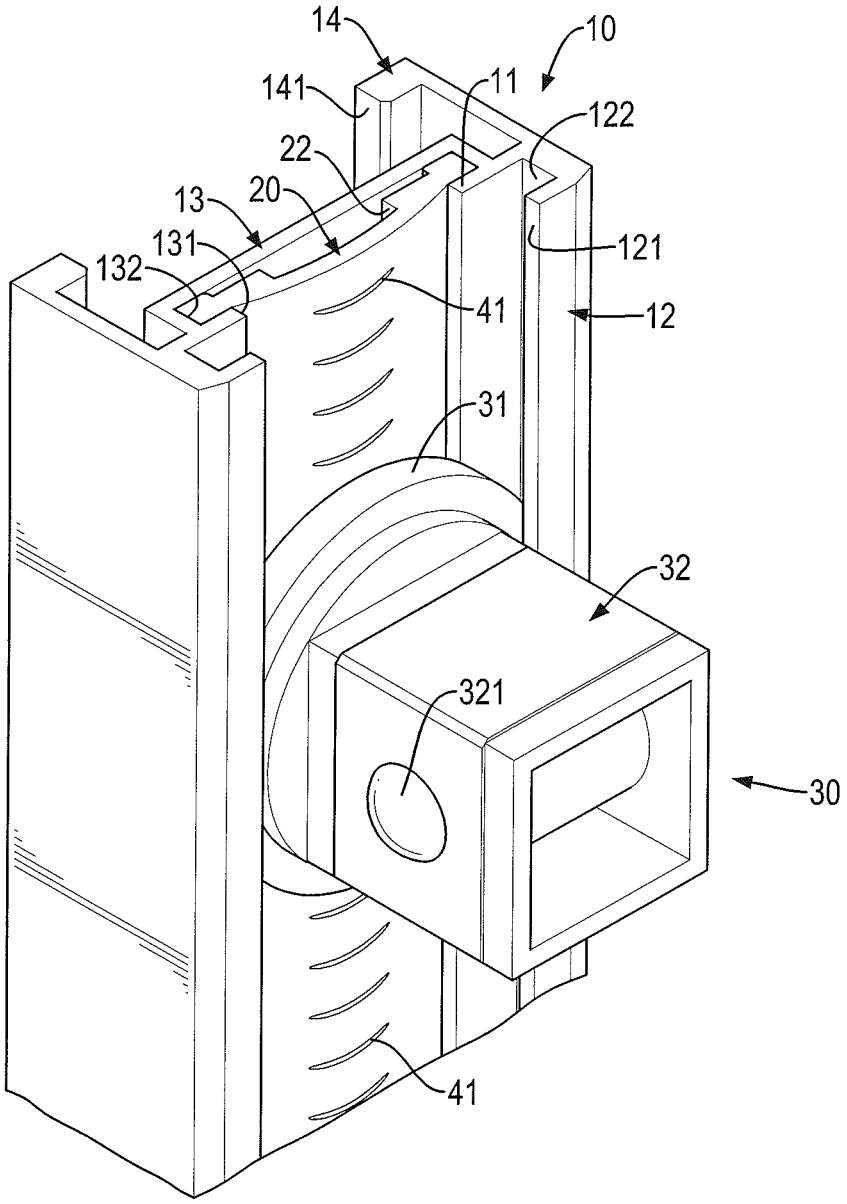
FIG. 1 is an enlarged perspective view of a first embodiment of a hand tool frame in accordance with the present invention.
Figure 2:
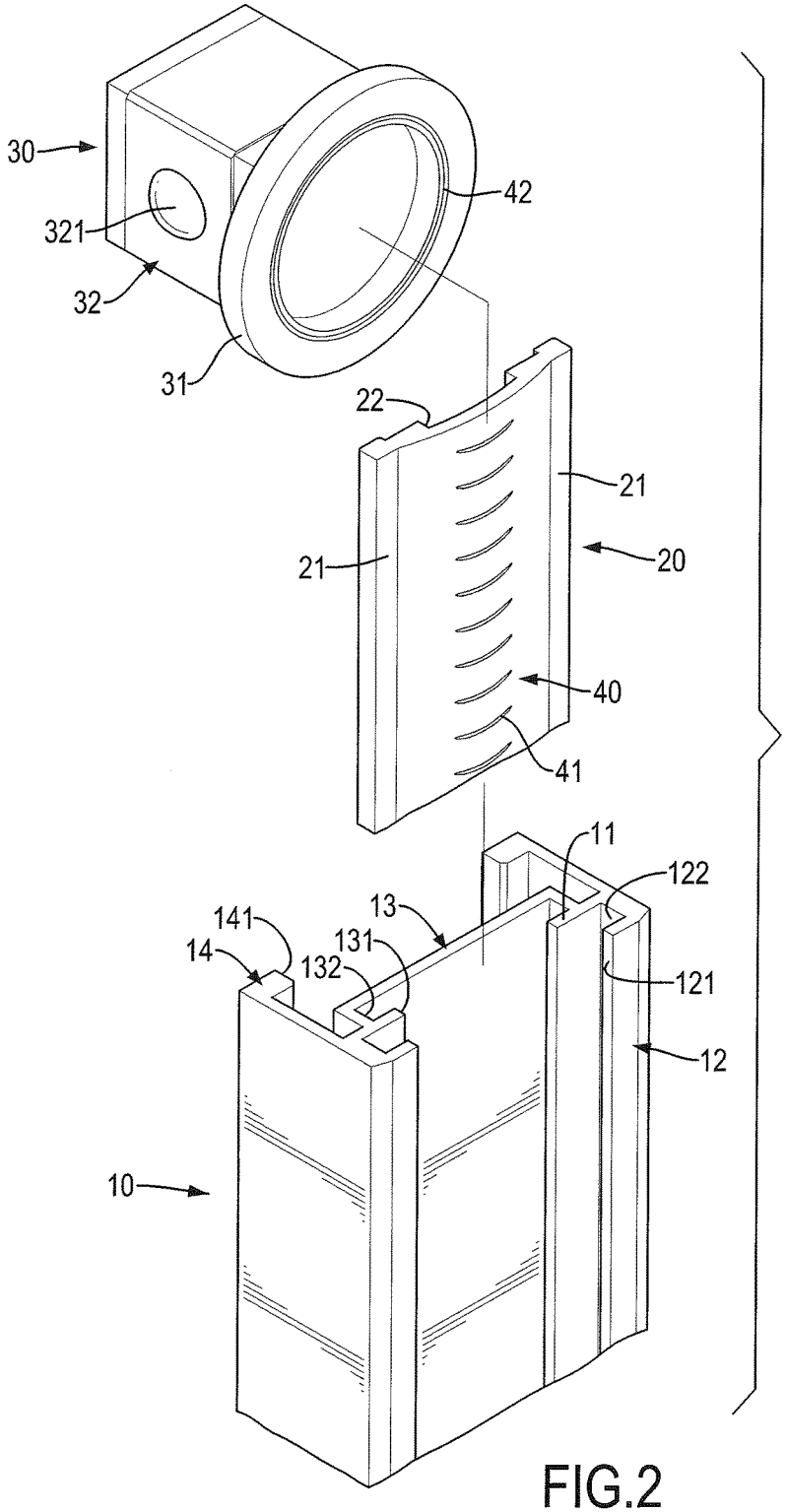
FIG. 2 is an enlarged and exploded perspective view of the hand tool frame in FIG. 1.
Figure 3:
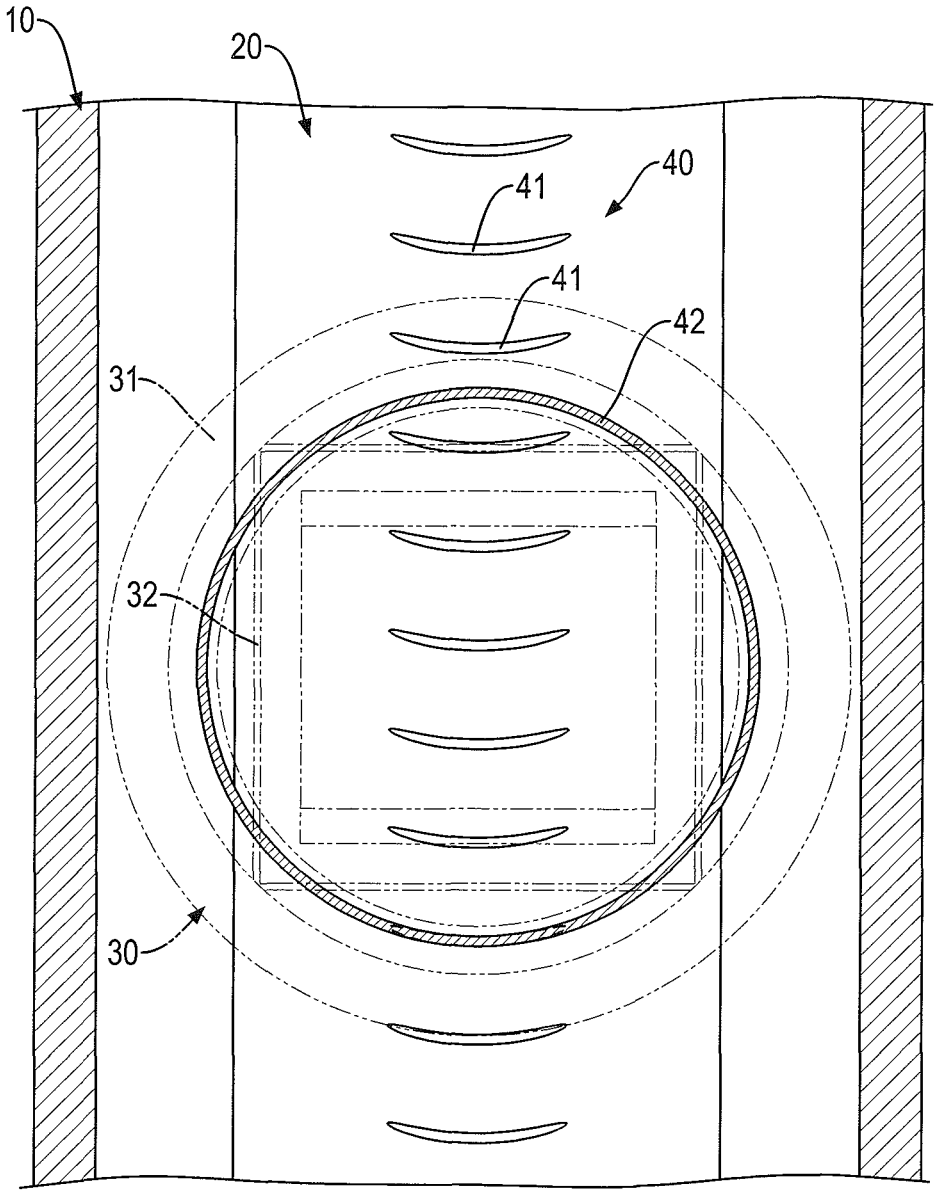
FIG. 3 is an enlarged cross sectional front side view of the hand tool frame in FIG. 1.

With reference to FIGS. 1 to 4, a first embodiment of a hand tool frame in accordance with the present invention comprises a track base 10, a positioning board 20, at least one positioning mount 30, and an engaging structure 40.

The track base 10 is made of aluminum, is an elongated seat and has a bottom panel 11, a slide rail 12, a connecting track 13, and a closed track 14. The bottom panel 11 is elongated and has a front surface, a rear surface, a top end, and a bottom end. The slide rail 12 is formed on and protrudes from the front surface of the bottom panel 11 between the top end and the bottom end of the bottom panel 11 and has a front side, a front opening 121, and a sliding recess 122. The front opening 121 is formed through the front side of the slide rail 12. The sliding recess 122 is formed in the slide rail 12 between the front side of the slide rail 12 and the front surface of the bottom panel 11 and communicates with the front opening 121.

The connecting track 13 is formed on and protrudes from the rear surface of the bottom panel 11, and has a front side, a communicating opening 131, and a connecting recess 132. The front side of the connecting track 13 is formed on and protrudes from the rear surface of the bottom panel 11. The communicating opening 131 is formed through the front side of the connecting track 13 and the rear surface of the bottom panel 11, and communicates with the sliding recess 122 of the slide rail 12. The connecting recess 132 is formed between the bottom panel 11 and the connecting track 13 and communicates with the communicating opening 131. Additionally, a width of the communicating opening 131 of the connecting track 13 is narrower than a width of the front opening 121 of the slide rail 12.

The closed track 14 is formed on and protrudes from the rear surface of the bottom panel 11 around the connecting track 13 and has a rear side and a rear opening 141 formed through the rear side of the closed track 14. In addition, the closed track 14 and the slide rail 12 are formed on the bottom panel 11 as a single piece.

The positioning board 20 is elastic, is mounted in the connecting track 13 of the track base 10 and has two long opposite sides, two free ends, a middle, a front surface, a rear surface, two rail bars 21, and a through recess 22. The positioning board 20 is bent forwardly from the long opposite sides of the positioning board 20 to the middle of the positioning board 20. Then, the front surface of the positioning board 20 at the middle of the positioning board 20 extends at the communicating opening 131 of the connecting track 13.

The two rail bars 21 are formed on and protrude outwardly from the rear surface of the positioning board 20 respectively at the two long opposite sides of the positioning board 20 and are mounted in the connecting recess 132 of the connecting track 13. The through recess 22 is formed in the rear surface of the positioning board 20 at the middle of the positioning board 20 between the free ends of the positioning board 20, is parallel with the long opposite sides of the positioning board 20 and communicates with the connecting recess 132 of the connecting track 13. Then, a space is formed between the connecting track 13 and the middle of the positioning board 20, and the space may allow the middle of the positioning board 20 to deform relative to the track base 10.

The at least one positioning mount 30 is slidably and rotatably mounted on the track base 10, and each one of the at least one positioning mount 30 has a sliding seat 31 and an extending element 32. The sliding seat 31 is round, is slidably mounted in the sliding recess 122 of the slide rail 12 and abuts the front surface of the positioning board 20. The sliding seat 31 has a rear side and a front side. The rear side of the sliding seat 31 faces the communicating opening 131 of the connecting track 13 and abuts the front surface of the positioning board 20. The front side of the sliding seat 31 faces the front opening 121 of the slide rail 12.

The extending element 32 is formed on and protrudes forwardly from the front side of the sliding seat 31 and extends out of the slide rail 12 via the front opening 121. The extending element 32 is used to hold a hand tool. Furthermore, in the first embodiment of the hand tool frame, the extending element 32 of each one of the at least one positioning mount 30 is an inserting button. The inserting button is hollow, is rectangular and has a side surface and a protruding ball 321. The protruding ball 321 is mounted in and extends outwardly from the side surface of the inserting button. Additionally, in the first embodiment, the hand tool frame has multiple positioning mounts 30 slidably and rotatably mounted on the track base 10 and abutting the positioning board 20.

The engaging structure 40 is formed between the positioning board 20 and the at least one positioning mount 30 to enable the at least one positioning mount 30 to position securely on the positioning board 20 without sliding relative to the track base 10. The engaging structure 40 has at least one first engaging segment 41 and a second engaging segment 42.

The at least one first engaging segment 41 is deposited on the front surface of the positioning board 20 at the middle of the positioning board 20. Furthermore, each one of the at least one first engaging segment 41 is a curved engaging slot and is formed in the front surface of the positioning board 20 at the middle of the positioning board 20. In addition, the hand tool frame has multiple first engaging segments 41 deposited on the front surface of the positioning board 20 at spaced intervals to form multiple engaging slots on the positioning board 20.

The second engaging segment 42 is deposited on the rear side of the sliding seat 31 of the at least one positioning mount 30, and selectively engages with the at least one first engaging segment 41 to hold the at least one positioning mount 30 securely on the positioning board 20 without sliding relative to the track base 10. In addition, the second engaging segment 42 is an engaging ring, is formed on and protrudes from the rear side of the sliding seat 31 of the at least one positioning mount 30, and selectively engages one of the engaging slots on the positioning board 20. Then, the at least one positioning mount 30 may be securely held on the positioning board 20 without sliding relative to the track base 10.

With further reference to FIGS. 4, 4A, and 4B, an interval d is between two adjacent engaging slots of the engaging structure 40, and the engaging ring has an inner diameter D. A mathematical relationship between the interval d and the inner diameter D is $5d<D<6d$, and this enables a part of the engaging ring to engage in one of the engaging slots and the remaining part of the engaging ring to press against the front surface of the positioning board 20 at the middle of the positioning board 20. Then, the abutment relationship between the engaging ring and the positioning board 20 may allow the part of the engaging ring to engage more securely in the corresponding engaging slot, and the at least one positioning mount 30 may be securely positioned on the positioning board 20.

Figure 5:
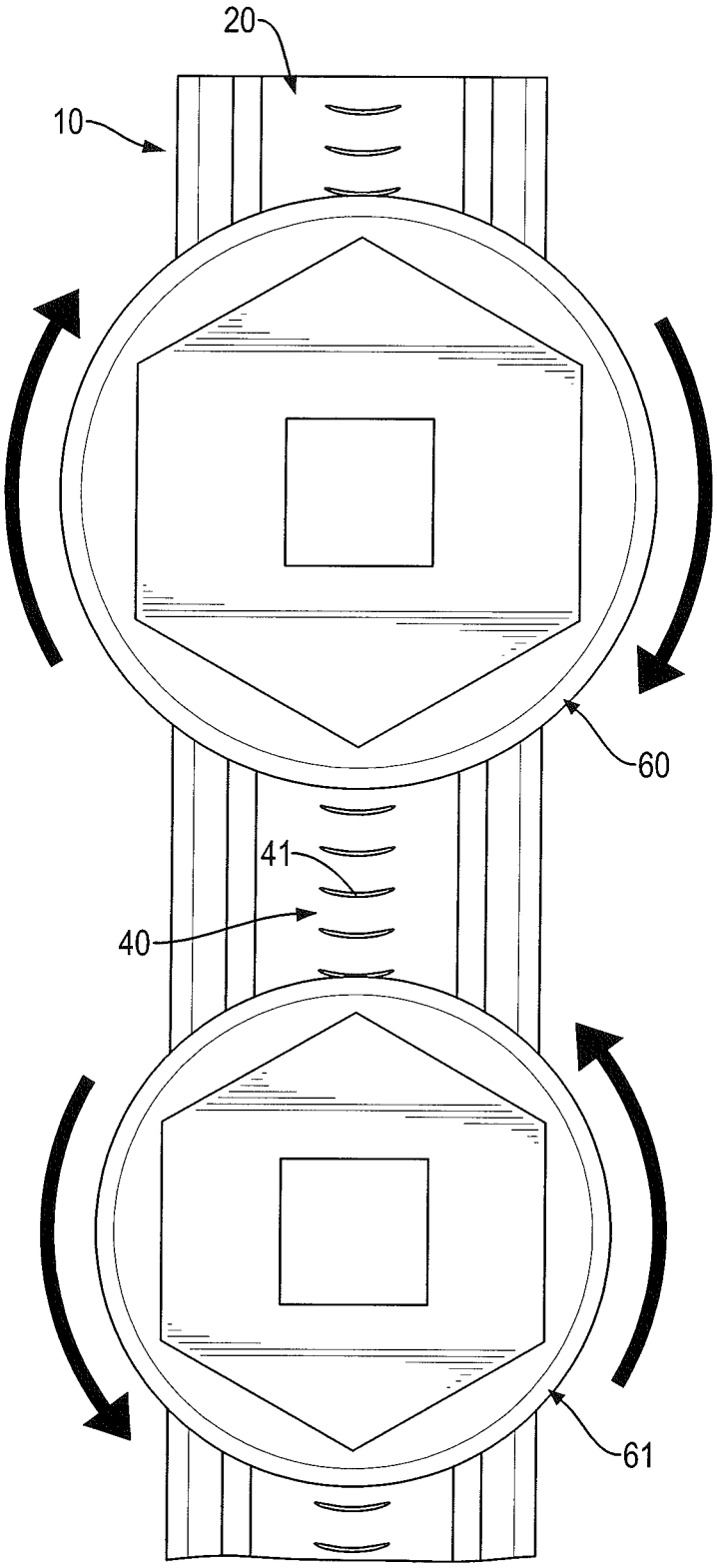
FIG. 5 is an enlarged operational front side view of the hand tool frame in FIG. 1, shown with two sleeves of different sizes mounted on the hand tool frame.
Figure 6:
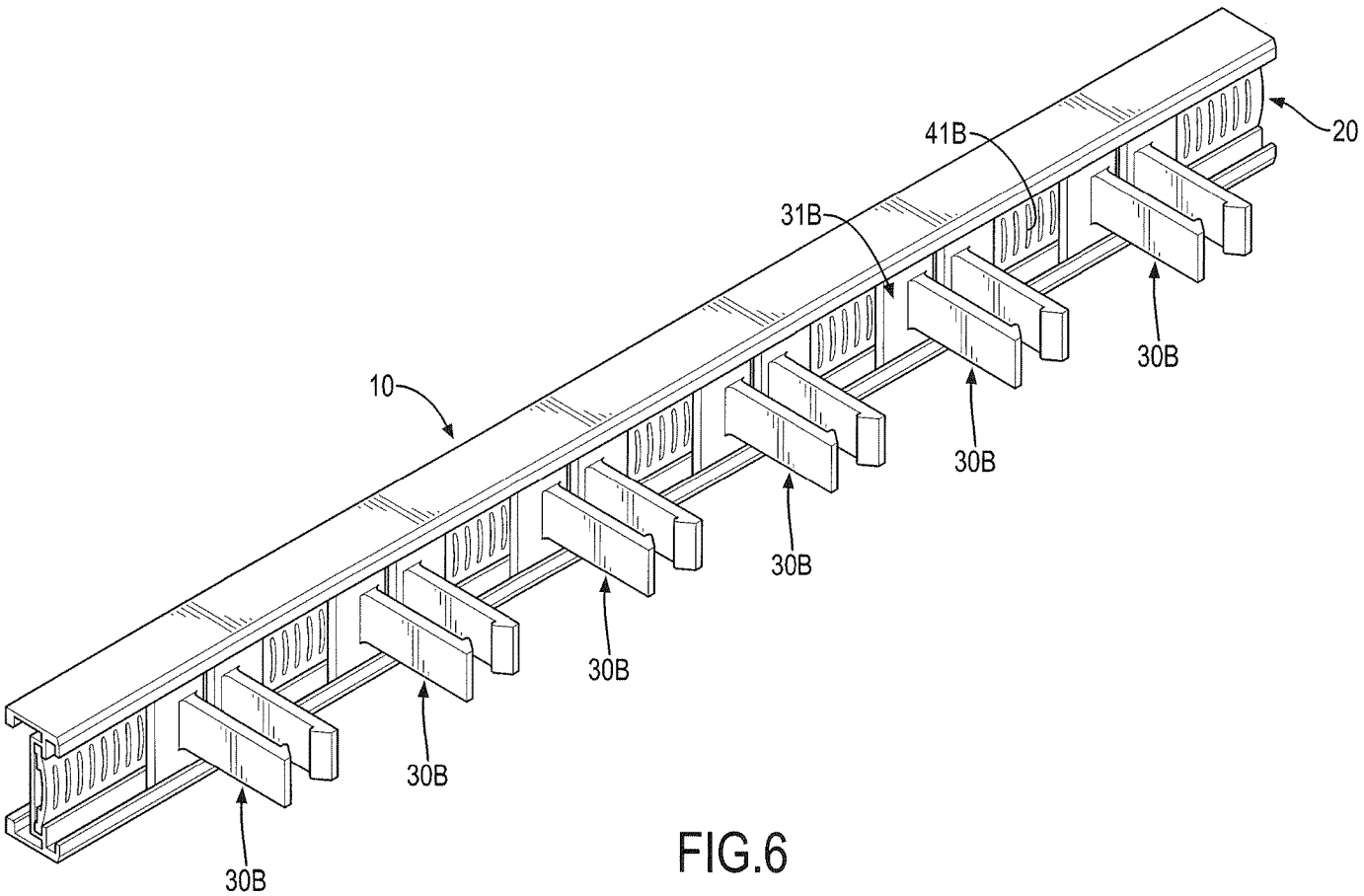
FIG. 6 is a perspective view of a second embodiment of a hand tool frame in accordance with the present invention.
Figure 7:
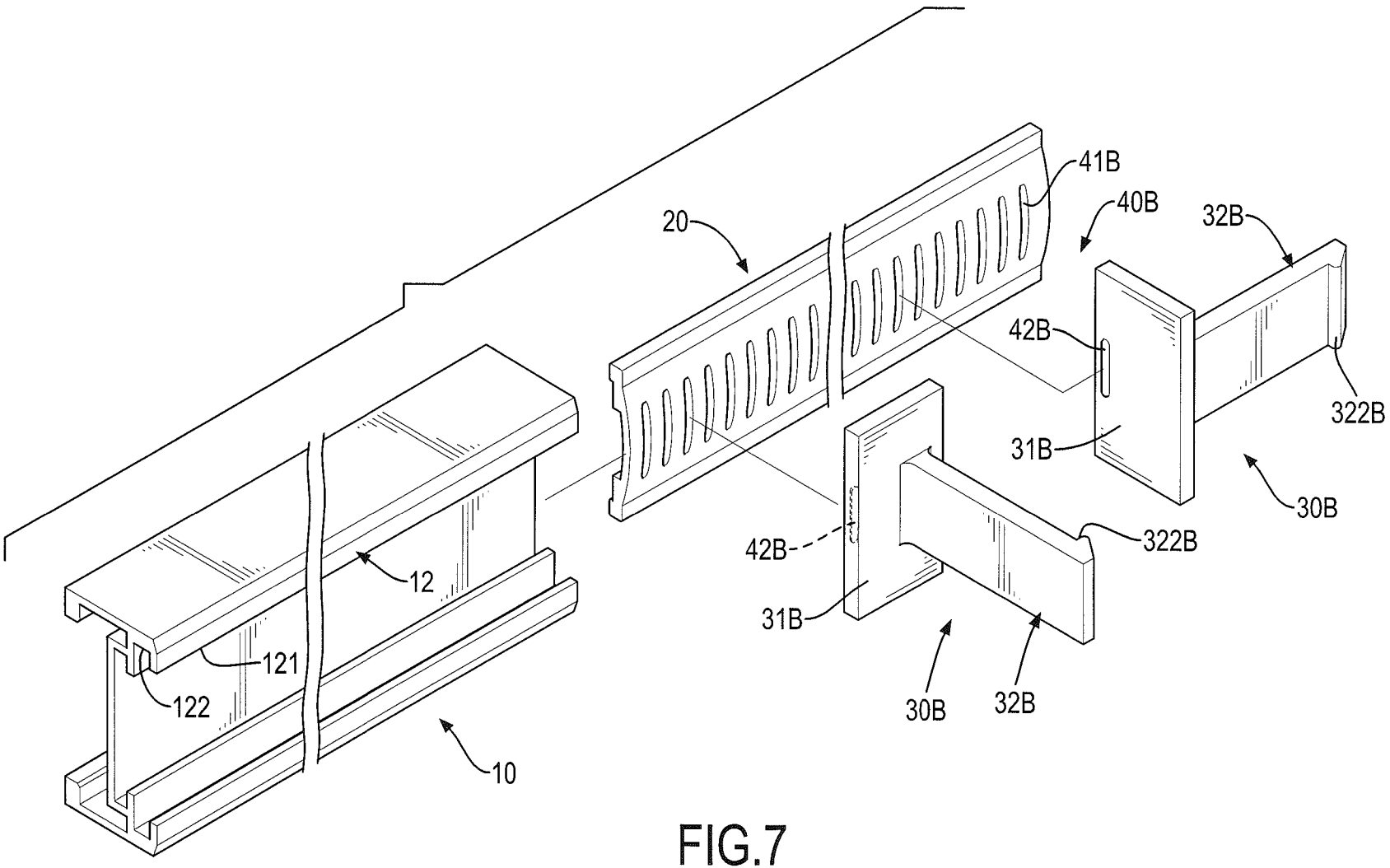
FIG. 7 is an enlarged and exploded perspective view of the hand tool frame in FIG. 6.
Figures 8, 8A, 8B:
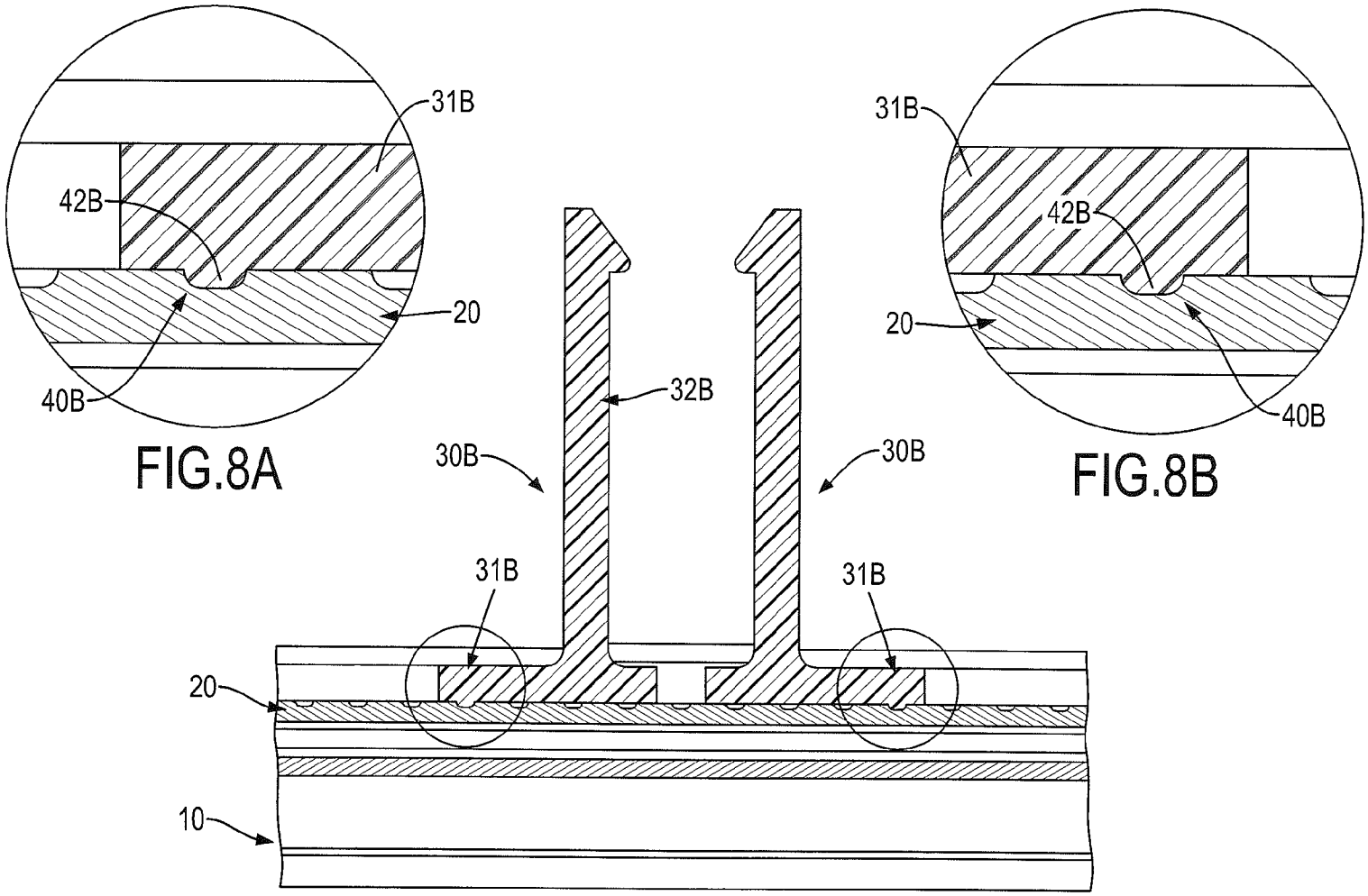
FIG. 8 is an enlarged and cross sectional side view of the hand tool frame in FIG. 6.
FIGS. 8A and 8B are enlarged side views of the hand tool frame in FIG. 8.

With reference to FIGS. 4 and 5, when the first embodiment of the hand tool frame in the present invention is in use, multiple sleeves 60 (large size), 61 (small size) are respectively and detachably mounted around the inserting buttons of the positioning mounts 30. When each sleeve 60, 61 is mounted around the inserting button of a corresponding positioning mount 30, the protruding ball 321 of the inserting button engages a recess in an inner wall of the sleeve 60, 61. Consequently, the sleeves 60, 61 are positioned on the inserting buttons of the positioning mounts 30. When numbers or signs on the sleeves 60, 61 are not aligned at a same direction to face a user, the user may rotate the sleeves 60, 61 in a clockwise or counterclockwise direction relative to the track base 10 as shown in FIG. 5 to enable the numbers or signs of the sleeves 60, 61 to face the user. During the above-mentioned rotating process, the sliding seats 31 of the positioning mounts 30 may be rotated with the sleeves 60, 61 relative to the positioning board 20 by the engagement between the inserting buttons of the positioning mounts 30 and the sleeves 60, 61.

When the sleeves 60, 61 are rotated to enable the number or sign on the sleeves 60, 61 to face the user, the engaging structure 40 between the positioning board 20 and the at least one positioning mount 30 may enable the engaging ring formed on the at least one positioning mount 30 to engage in one of the engaging slots formed in the positioning board 20. That is, the engaging structure 40 may provide a positioning effect to the at least one positioning mount 30 relative to the positioning board 20. Then, the at least one positioning mount 30 may be positioned securely on the positioning board 20 without rotating relative to the track base 10, and the weights of the sleeves 60, 61 may not force the positioning mounts 30 to move downwardly relative to the track base 10. The user may see and distinguish the sizes of the sleeves by the numbers or signs easily and conveniently.

Furthermore, when the user wants to take the sleeve 61 (small size) that is mounted on a lower positioning mount 30, the upper positioning mount 30 is positioned on the positioning board 20 without sliding downwardly to shorten a distance between the two adjacent positioning mounts 30 and knocking against the lower positioning mount 30. After using the small size sleeve 61, the user may re-mount the small size sleeve 61 on the lower positioning mount 30 easily without moving the upper positioning mount 30 and the large size sleeve 60 upwardly. This is convenient in use and storage.

With reference to FIGS. 6 to 8, 8A, and 8B, a second embodiment of a hand tool frame in accordance with the present invention is substantially the same as the first embodiment except for the following features. The hand tool frame has at least one pair of positioning mounts 30B. Each one of the at least one pair of positioning mounts 30B has a sliding seat 31B and an extending element 32B. The sliding seat 31B is rectangular and is un-rotatably and slidably mounted in the sliding recess 122 of the slide rail 12. The extending element 32B is a clamping arm and is formed on the front side of the sliding seat 31B and has a free end and a holding hook 322B. The free end of the clamping arm extends out of the slide rail 12 via the front opening 121, and the holding hook 322B is formed on the free end of the clamping arm. The holding hooks 322B of the at least one pair of positioning mounts 30B face each other, and a holding space is formed between the clamping arms of the at least one pair of positioning mounts 30B.

The engaging structure 40B is formed between the positioning board 20 and each one of the at least one pair of positioning mounts 30B, and has a first engaging segment 41B and a second engaging segment 42B. The first engaging segment 41B is an elongated engaging slot and is formed in the front surface of the positioning board 20 at the middle of the positioning board 20. The second engaging segment 42B is an elongated engaging rib, is formed on and protrudes from the rear side of the sliding seat 31B, and selectively engages with the engaging slot to hold a corresponding positioning mount 30B securely on the positioning board 20.

Figure 9:
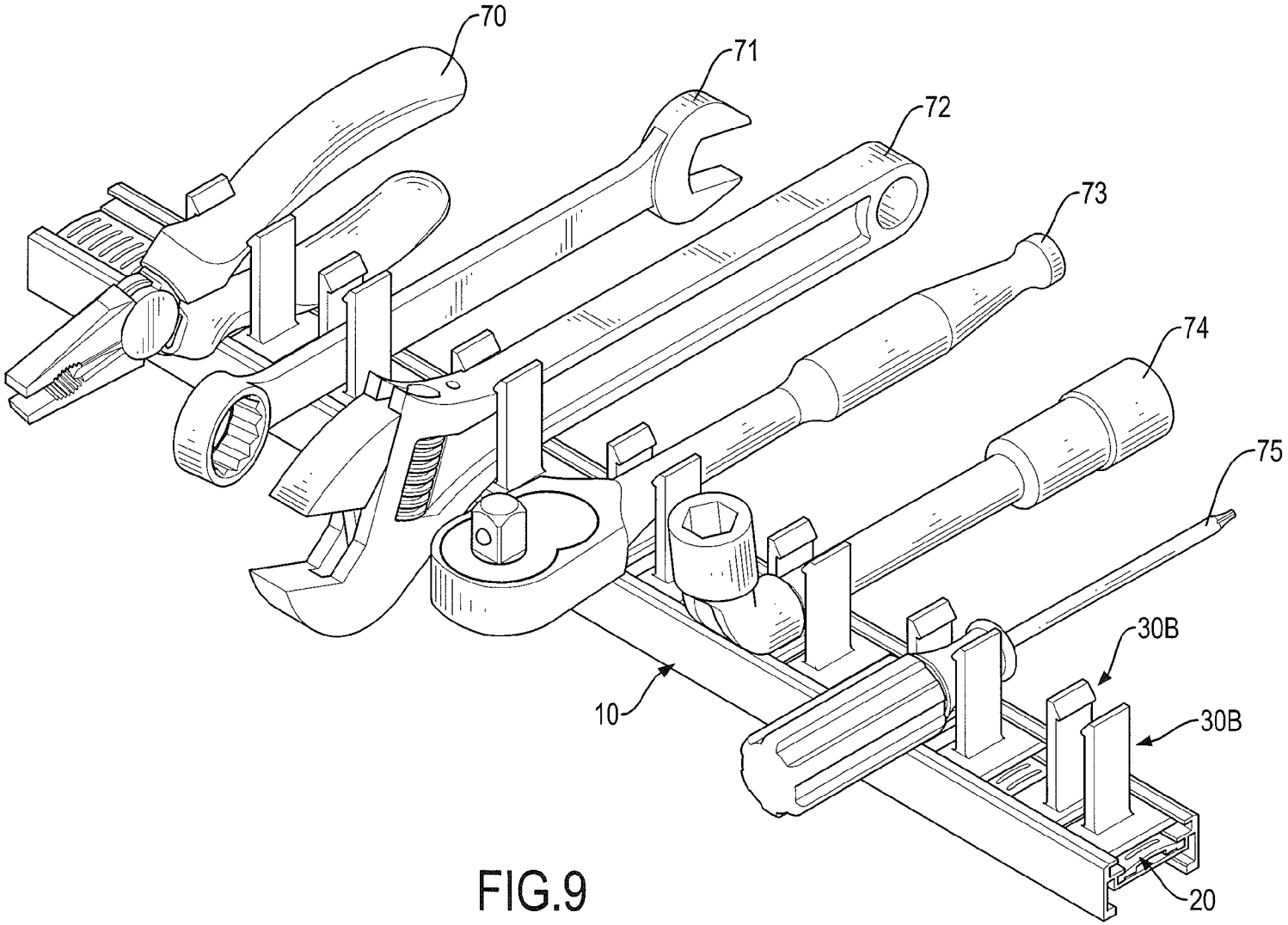
FIG. 9 is an operational perspective view of the hand tool frame in FIG. 6, shown with forceps, wrenches and screwdrivers mounted on the hand tool frame.

With reference to FIG. 9, when the hand tool frame of the second embodiment in the present invention is in use, different kinds of hand tools such as pliers 70, combination spanners 71, adjustable wrenches 72, socket wrenches 73, hexagonal wrenches 74 or screwdrivers 75 may be inserted into a holding space that is formed between the clamping arms of the at least one pair of positioning mounts 30B, and the holding hooks 322B may prevent the hand tool separating from the at least one pair of positioning mounts 30B. Furthermore, the holding space between the clamping arms of the at least one pair of positioning mounts 30B may be adjusted by moving the sliding seats 31B of the at least one pair of positioning mounts 30B along the positioning board 20 relative to the track base 10. After adjusting the holding space between the at least one pair of positioning mounts 30B, the at least one pair of positioning mounts 30B may be positioned on the positioning board 20 by the engaging structure 40B. Then, the different kinds of hand tools may be held securely on the track base 10 by the positioning mounts 30B. This will improve the practicality of the hand tool frame.

Figure 10:
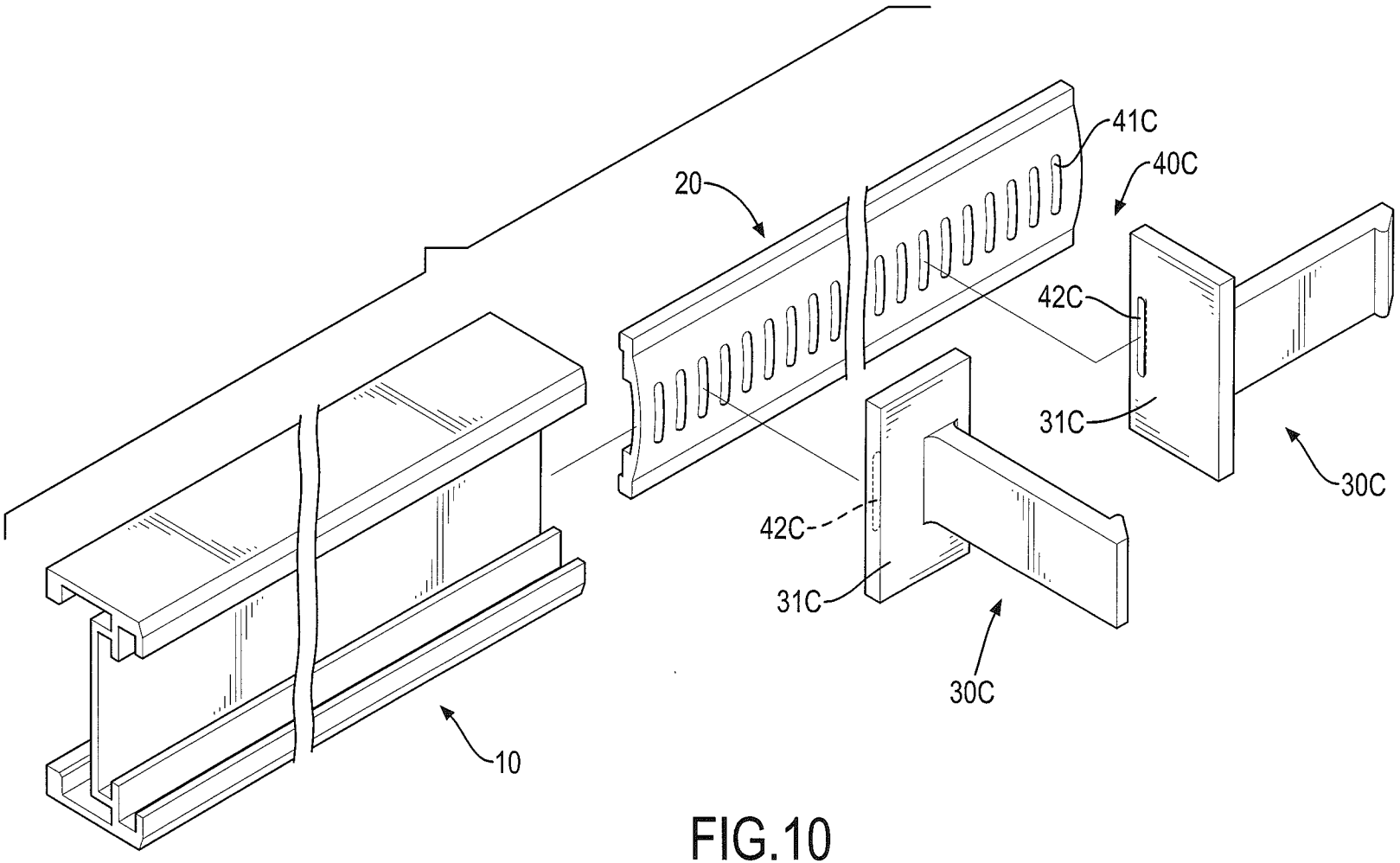
FIG. 10 is an enlarged and exploded perspective view of a third embodiment of a hand tool frame in accordance with the present invention.

With reference to FIG. 10, a third embodiment of a hand tool frame in accordance with the present invention is substantially the same as the second embodiment except for the following features. In the third embodiment, the first engaging segment 41C of the engaging structure 40C is an elongated engaging rib, and is formed on and protrudes from the front surface of the positioning board 20. Additionally, the second engaging segment 42C of the engaging structure 40C is an elongated engaging slot, is formed in the rear side of the sliding seat 31C, and selectively engages with the engaging rib to hold a corresponding positioning mount 30C securely on the positioning board 20.

Furthermore, the operation of the third embodiment of the hand tool frame is substantially the same as the operation of the second embodiment that is mentioned above, and is not described in detail.

Figure 11:
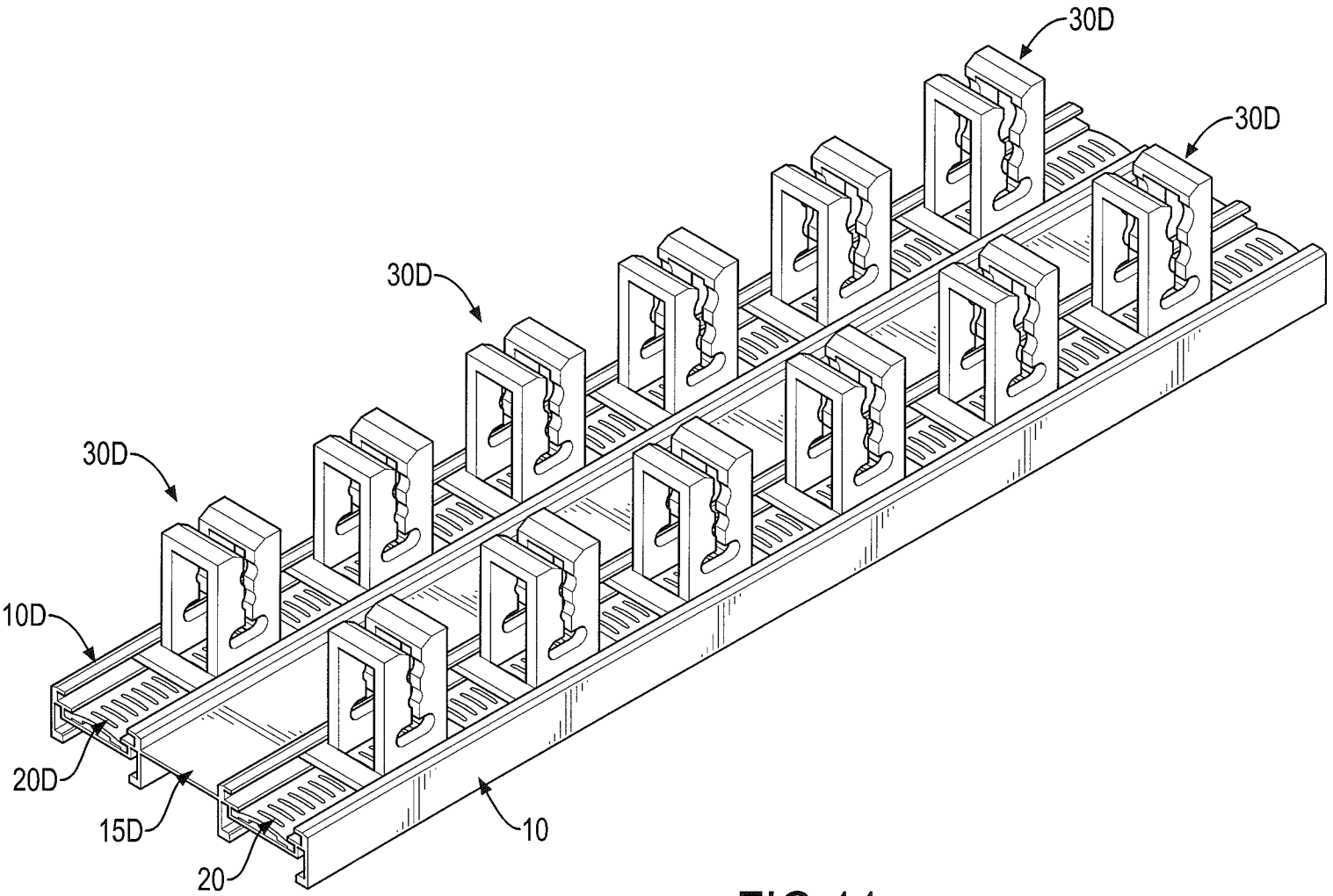
FIG. 11 is a perspective view of a fourth embodiment of a hand tool frame in accordance with the present invention.
Figure 12:
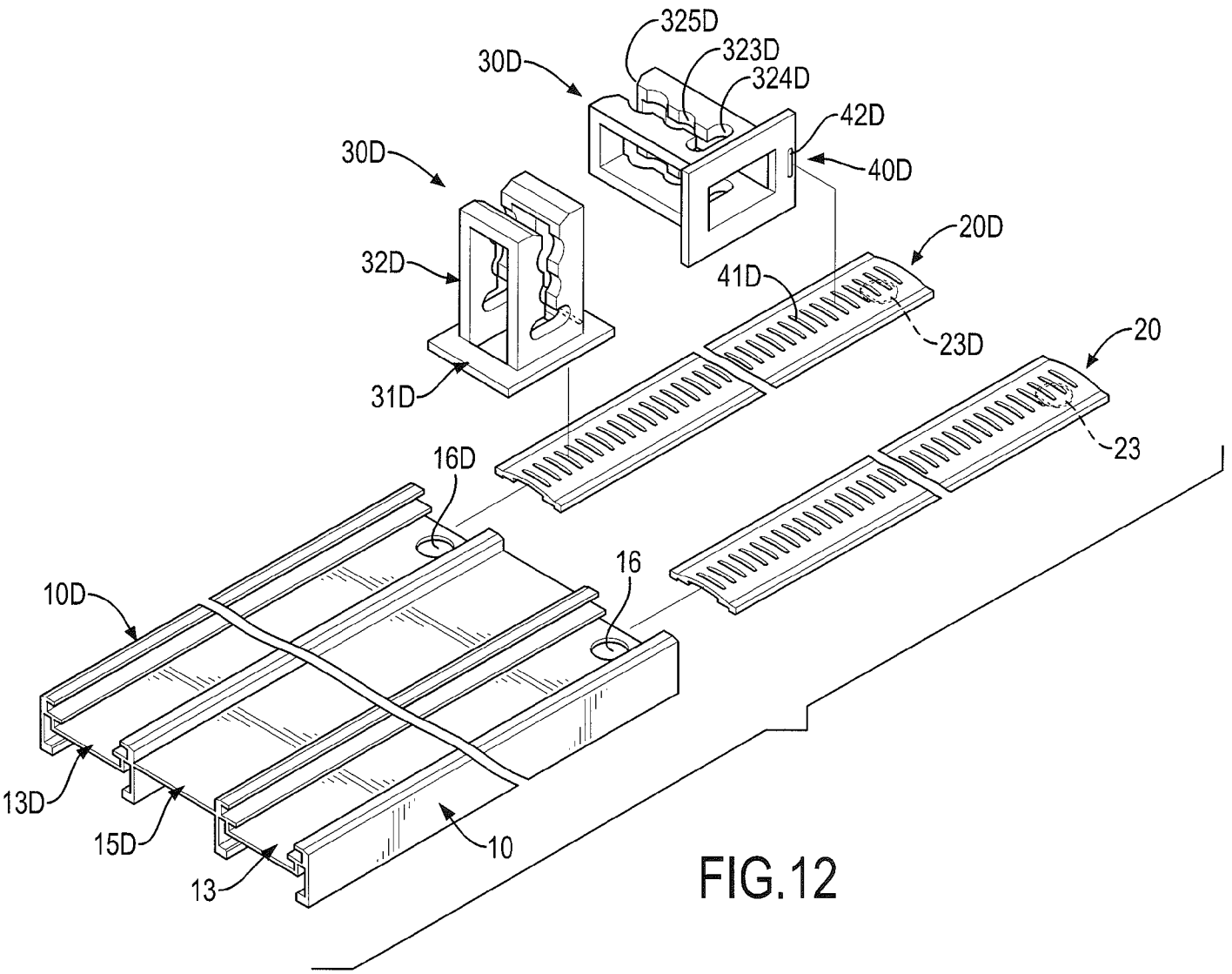
FIG. 12 is an enlarged and exploded perspective view of the hand tool frame in FIG. 11.

With reference to FIGS. 11 and 12, a fourth embodiment of a hand tool frame in accordance with the present invention is substantially the same as the first embodiment except for the following features. The hand tool frame further has an extending track base 10D and an additional positioning board 20D. The extending track base 10D is connected to and parallel with the track base 10 by an extending panel 15D. Furthermore, the structure of the extending track base 10D is substantially the same as the track base 10, and each one of the track bases 10, 10D further has a mounting hole 16, 16D formed through the connecting track 13, 13D adjacent to one of the free ends of the connecting track 13, 13D.

Furthermore, the additional positioning board 20D is mounted in the extending track base 10D, and the structure of the additional positioning board 20D is substantially the same as the positioning board 20. One of the free ends of each one of the positioning boards 20, 20D is a closed end, and each one of the positioning boards 20, 20D has an engaging protrusion 23, 23D formed on the rear surface of the positioning board 20, 20D adjacent to the closed end of the positioning board 20, 20D. In assembly, the engaging protrusion 23, 23D of each one of the positioning boards 20, 20D engages the mounting hole 16, 16D of a corresponding track base 10, 10D to hold the positioning board 20, 20D securely with the corresponding track base 10, 10D.

Figure 13:
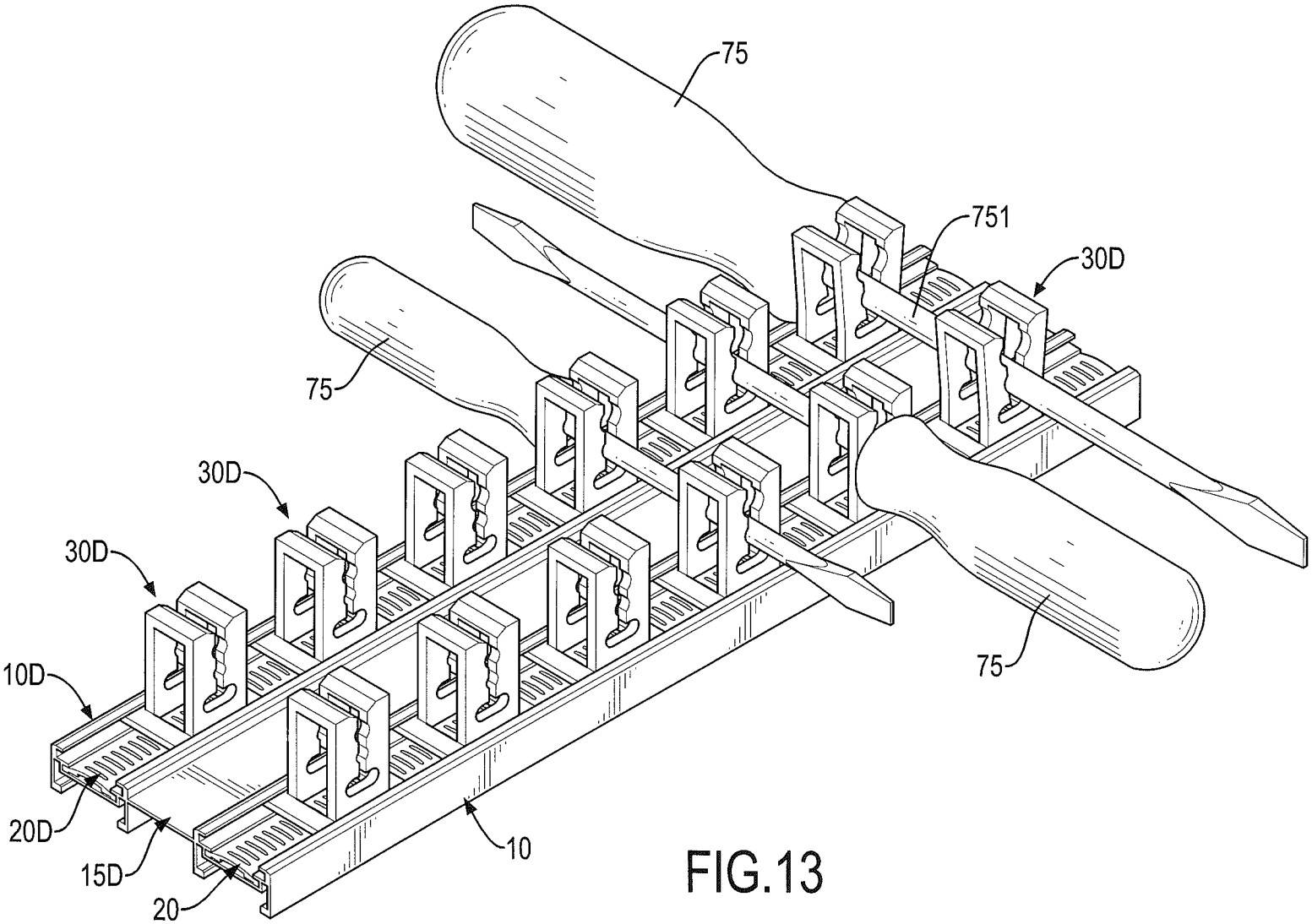
FIG. 13 is an operational perspective view of the hand tool frame in FIG. 11, shown with screwdrivers mounted on the hand tool frame.

The at least one positioning mount 30D is mounted in the track base 10 or the extending track base 10D, and each positioning mount 30D has a sliding seat 31D and an extending element 32D. The sliding seat 31D is rectangular and is un-rotatably and slidably mounted in the track base 10 or the extending track base 10D. The extending element 32D is a hollow block, is formed on the front side of the sliding seat 31D, and has two sidewalls, a front side, at least one tool hole 323D, a tool slot 324D, and a mounting slit 325D. The at least one tool hole 323D is formed through the sidewalls of the extending element 32D to hold a shank 751 of a screwdriver 75 as shown in FIG. 13. The tool slot 324D is formed through the sidewalls of the extending element 32D and communicates with the at least one tool hole 323D. The mounting slit 325D is formed through the front side and the sidewalls of the extending element 32D and communicates with the at least one tool hole 323D opposite to the tool slot 324D.

With reference to FIG. 13, when the hand tool frame of the fourth embodiment in the present invention is in use, a shank 751 of a screwdriver 75 is inserted into two positioning mounts 30D that are respectively mounted in the track bases 10, 10D and align with each other via the mounting slits 325D of the extending elements 32D, and is held between two tool holes 323D of the extending elements 32D. Since the positioning mounts 30D are securely mounted on the track bases 10, 10D by the engaging structure 40D between the positioning mounts 30D and the positioning boards 20, 20D, the screwdrivers 75 may be securely held on the track bases 10, 10D of the hand tool frame. This may also improve the practicality of the hand tool frame.

Figure 14:
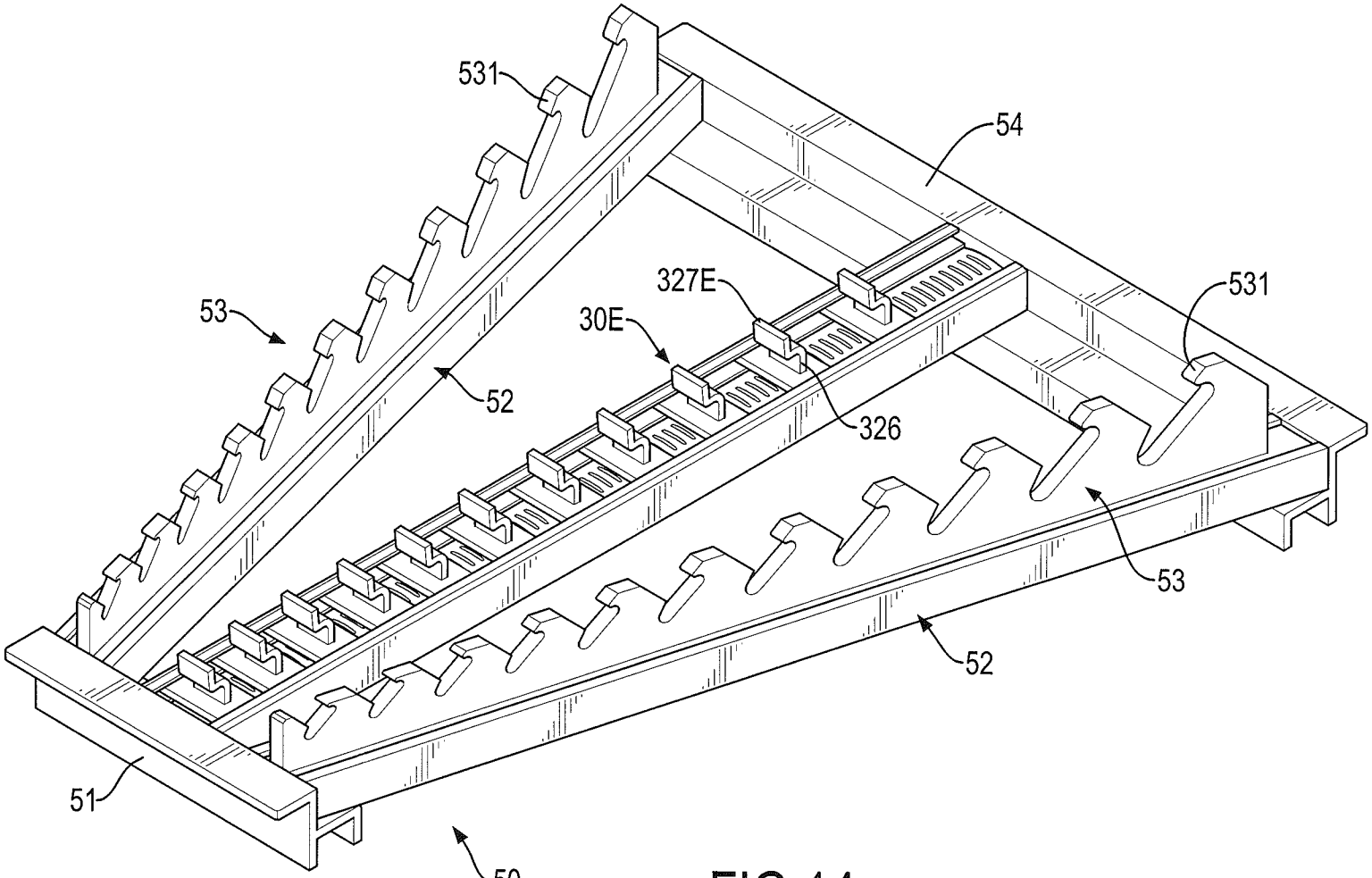
FIG. 14 is a perspective view of a fifth embodiment of a hand tool frame in accordance with the present invention.
Figure 15:
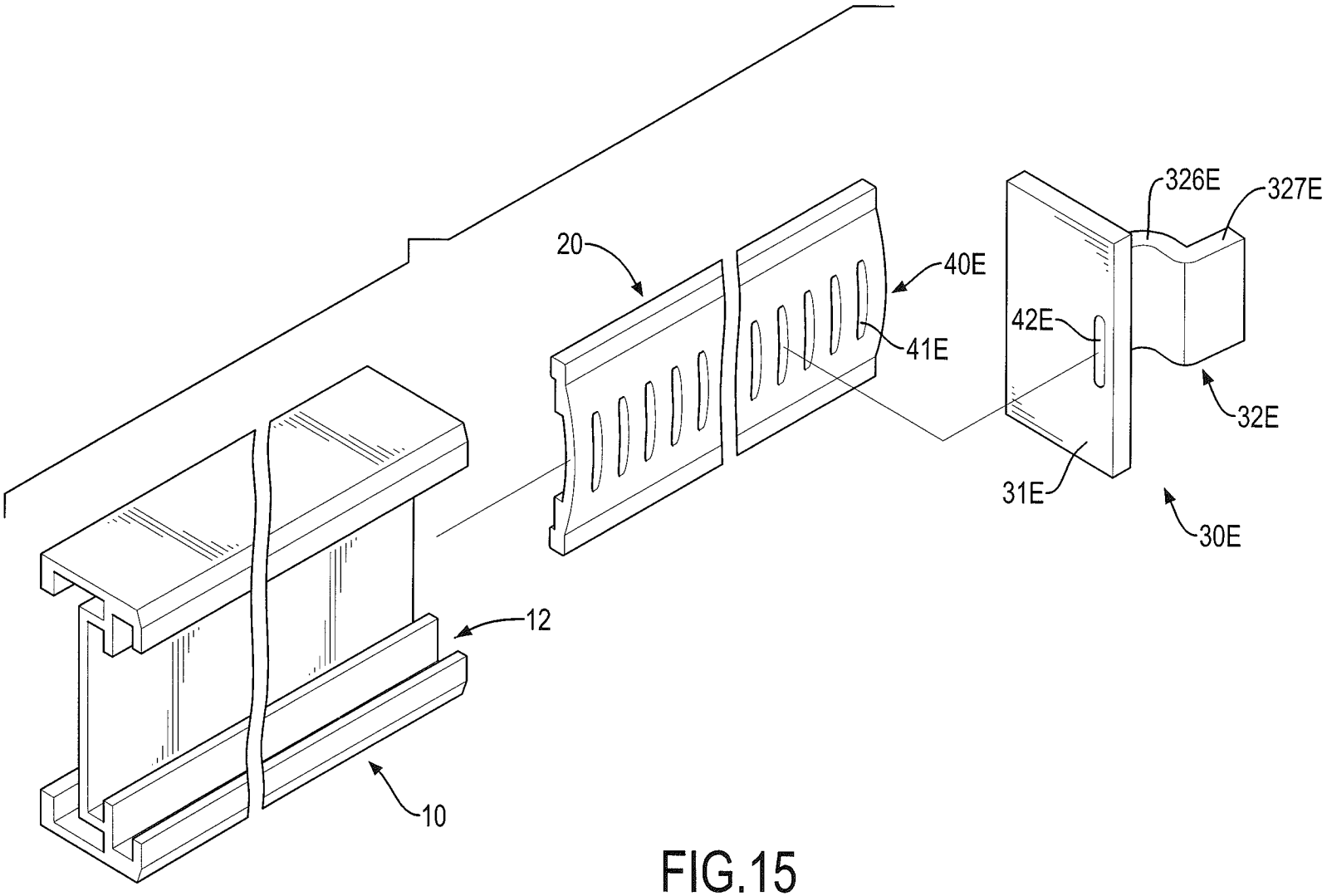
FIG. 15 is an enlarged and exploded perspective view of the hand tool frame in FIG. 14.

With reference to FIGS. 14 and 15, a fifth embodiment of a hand tool frame in accordance with the present invention is substantially the same as the first embodiment except for the following features. The hand tool frame further has an outer frame 50 connected to the track base 10 and having a first supporting mount 51, two side supporting racks 52, two clamping panels 53, and a second supporting mount 54.

The first supporting mount 51 is connected to an end of the track base 10 to provide a holding effect to a user and has a length. The side supporting racks 52 are connected to the first supporting mount 51 beside the track base 10. The clamping panels 53 are respectively mounted in the side supporting racks 52, and each one of the clamping panels 53 has multiple clamping claws 531 continuously formed on a top side of the clamping panel 53 and extending out of a corresponding side supporting rack 52. The second supporting mount 54 is connected to the track base 10 opposite to the first supporting mount 51, is connected to the side supporting racks 52, and has a length longer than the length of the first supporting mount 51. Then, the outer frame 50 is formed as a trapezoid frame by the supporting mounts 51, 54 and the side supporting racks 52.

The at least one positioning mount 30E is un-rotatably mounted in track base 10, and each one of the at least one positioning mount 30E has a sliding seat 31E and an extending element 32E. The sliding seat 31E is rectangular and is un-rotatably and slidably mounted in the slide rail 12 of the track base 10. The extending element 32E is an elastic arm, is formed on the front side of the sliding seat 31E, and has a curved segment 326E and a limiting segment 327E. The curved segment 326E is curvedly formed on and protrudes from the sliding seat 31E and has a free end extending out of the slide rail 12. The limiting segment 327E is formed on and protrudes from the free end of the curved segment 326E of the elastic arm to abut against a combination spanner 71 as shown in FIG. 16.

The engaging structure 40E is formed between the positioning board 20 and each one of the at least one positioning mount 30E, and has a first engaging segment 41E and a second engaging segment 42E. The first engaging segment 41E is an elongated engaging slot and is formed in the front surface of the positioning board 20 at the middle of the positioning board 20. The second engaging segment 42E is an elongated engaging rib, is formed on and protrudes from the rear side of the sliding seat 31E, and selectively engages with the engaging slot to hold a corresponding positioning mount 30E securely on the positioning board 20.

Figure 16:
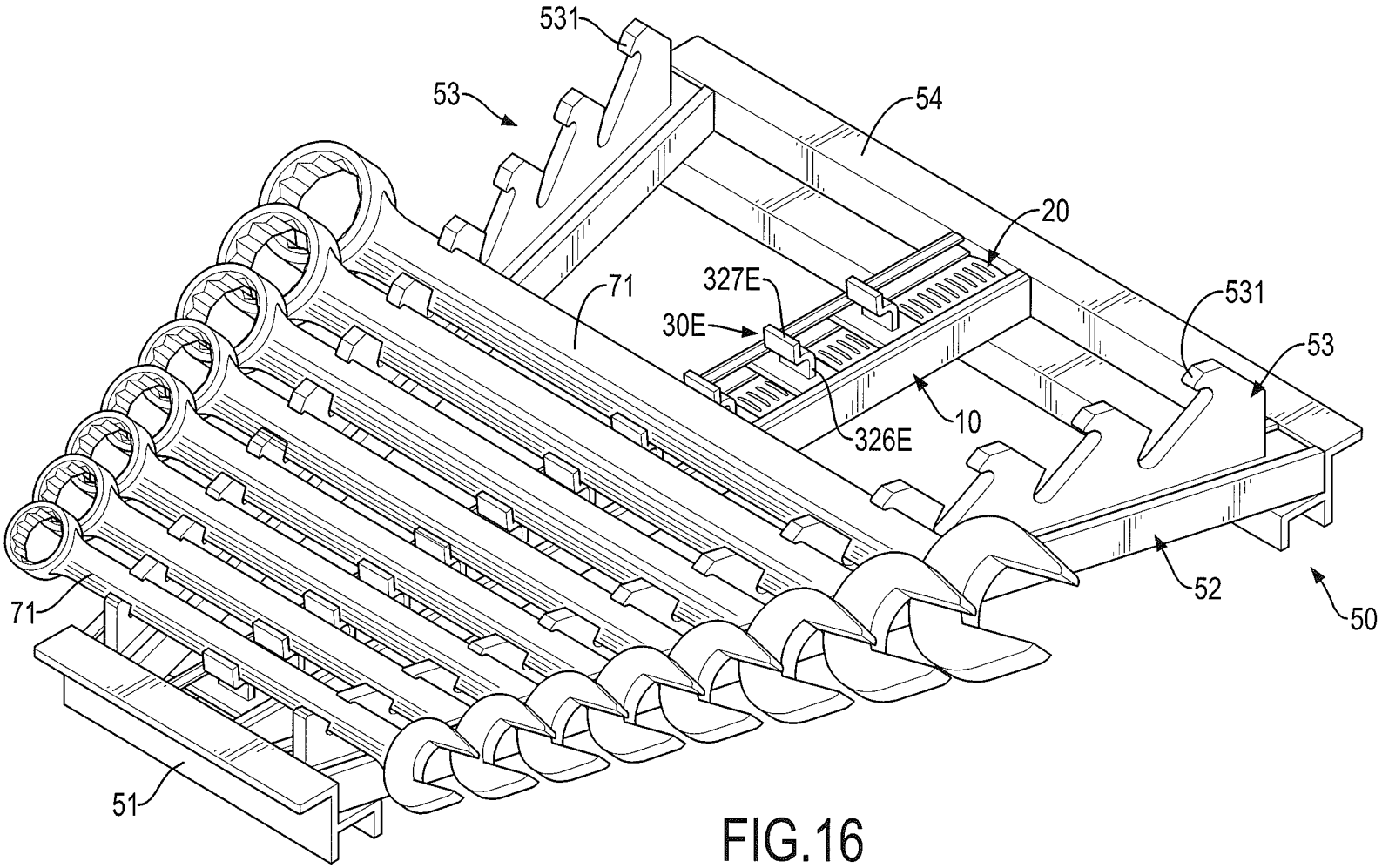
FIG. 16 is an operational perspective view of the hand tool frame in FIG. 14, shown with wrenches of different sizes mounted on the hand tool frame.

With reference to FIG. 16, when combination spanners 71 of different sizes are mounted on the fifth embodiment of the hand tool frame, the combination spanners 71 are held in the clamping claws 531 of the clamping panels 53, and the position of the extending element 32E of each one of the positioning elements 30E may be adjusted by separating the engagement that is formed by the engaging structure 40E between the positioning board 20 and each one of the positioning mounts 30E, and moving the positioning mounts 30E relative to the track base 10 to enable the limiting segment 327E of the elastic arm to move close to and abut against a corresponding combination spanner 71. Furthermore, the curved segment 326E of the elastic arm may be elastically deformed to closely abut against a corresponding combination spanner 71. Then, the combination spanners 71 of different sizes can be securely held on the hand tool frame between the clamping claws 531 of the clamping panels 53 and the positioning elements 30E. This also can improve the practicality of the hand tool frame.

Figure 17:
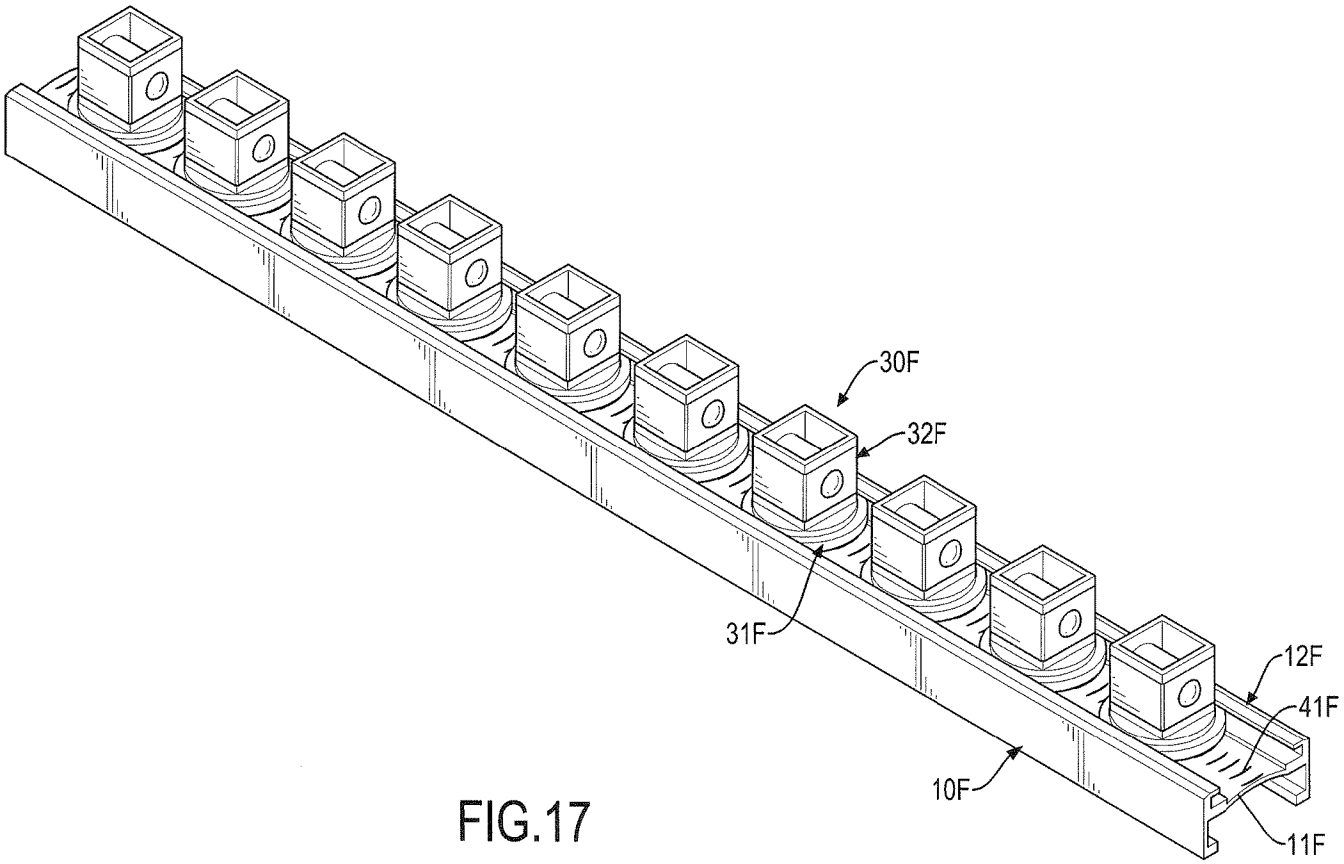
FIG. 17 is a perspective view of a sixth embodiment of a hand tool frame in accordance with the present invention.
Figure 18:
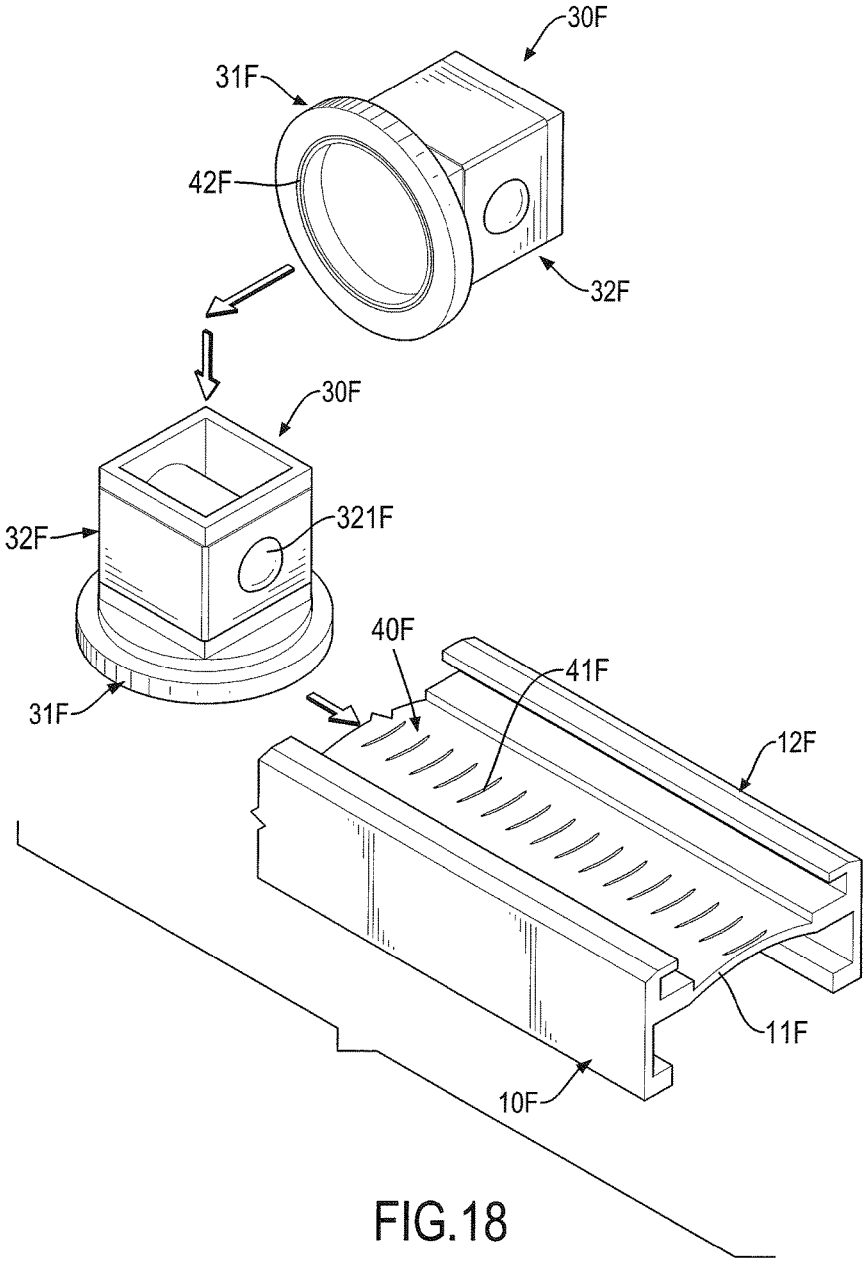
FIG. 18 is an enlarged exploded perspective view of the hand tool frame in FIG. 17.

With reference to FIGS. 17 and 18, a sixth embodiment of a hand tool frame in accordance with the present invention is substantially the same as the first embodiment except for the following features. The sixth embodiment of the hand tool frame does not have a positioning board 20 that is disclosed in the first embodiment of the hand tool frame in the present invention, and the engaging structure 40F is formed between the track base 10F and the at least one positioning mount 30F.

The at least one first engaging segment 41F of the engaging structure 40F is deposited on a top surface of the bottom panel 11F. Furthermore, the engaging structure 40F has multiple first engaging segments 41F deposited on the top surface of the bottom panel 11F at spaced intervals. The first engaging segments 41F are aligned in a straight line and are preferably formed at a middle of the top surface of the bottom panel 11F at spaced intervals. Furthermore, each one of the at least one first engaging segment 41F is a curved engaging slot.

The sliding seat 31F of each one of the at least one positioning mount 30F has a bottom side. The engaging structure 40F has at least one second engaging segment 42F deposited on the bottom side of the sliding seat 31F of the at least one positioning mount 30, and selectively engaging with the at least one first engaging segment 41F to hold the at least one positioning mount 30F securely on the track base 10F without sliding relative to the track base 10F.

With reference to FIGS. 17 and 18, to attach each positioning mount 30F onto the track base 10F, the positioning mount 30F is rotated to align the sliding groove 43F with the first engaging segments 41F. The positioning mount 30F is then put into the slide rail 12F from one end of the track base 10F. Consequently, the positioning mount 30F can be moved to a desired position by the engagement between the first engaging segments 41F and the second engaging segment 42F. This enables the positioning mount 30F to be positioned relative to the track base 10F.

Figure 19:
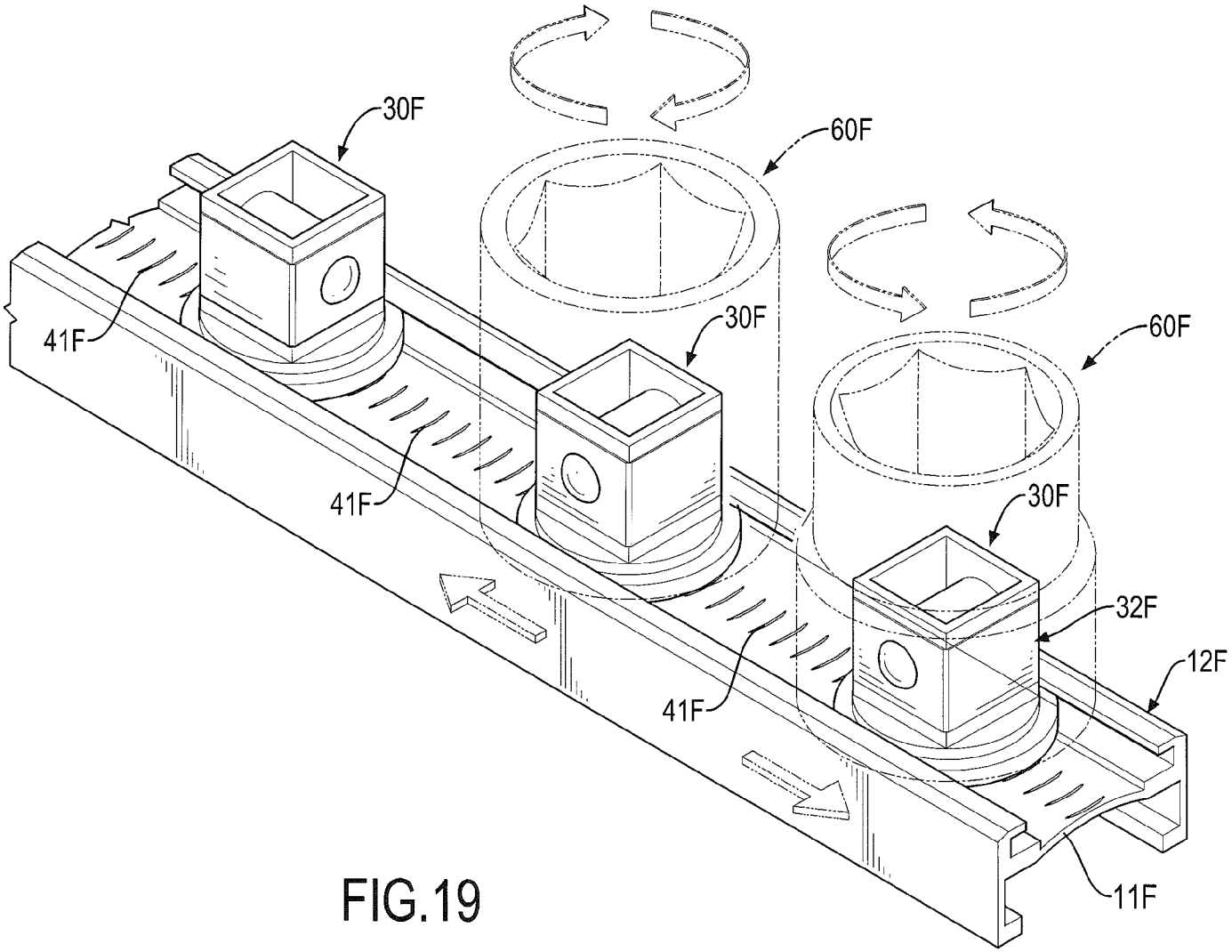
FIG. 19 is an enlarged operational perspective view of the hand tool frame in FIG. 17.

With reference to FIG. 19, when the hand tool frame in the present invention is in use, the hand tool frame has multiple positioning mounts 30F mounted on the track base 10F, and multiple sockets 60F are respectively and detachably mounted around the extending elements 32F of the positioning mounts 30F. When each socket 60F is mounted around the extending element 32F of a corresponding positioning mount 30F, the protruding ball 321F of the extending element 32F engages with a recess in an inner wall of the socket 60F. Consequently, the sockets 60F are positioned on the extending elements 32F of the positioning mounts 30F. When numbers or signs on the sockets 60F are not aligned at a same direction to face a user, the user may rotate the sockets 60F in a clockwise or counterclockwise direction relative to the track base 10F as shown in FIG. 19 to enable the numbers or signs of the sockets 60F to face the user. During the above-mentioned rotating process, the sliding seats 31F of the positioning mounts 30F may be rotated with the sockets 60F relative to the track base 10F by the engagement between the extending elements 32F of the positioning mounts 30F and the sockets 60F.

When the sockets 60F are rotated to enable the numbers or signs on the sockets 60F to face the user, the engagement between the second engaging segment 42F and the first engaging segments 41F of the engaging structure 40F enables the sliding seats 31F to engage with the track base 10F. That is, the engagement between the second engaging segment 42F and the first engaging segments 41F provides a positioning effect to the positioning mounts 30F on the track base 10F. Therefore, the positioning mounts 30F may be positioned securely on the track base 10F at desired positions, and the user may recognize the sizes of the sockets 60F by the numbers or signs easily and conveniently.

Figure 20:
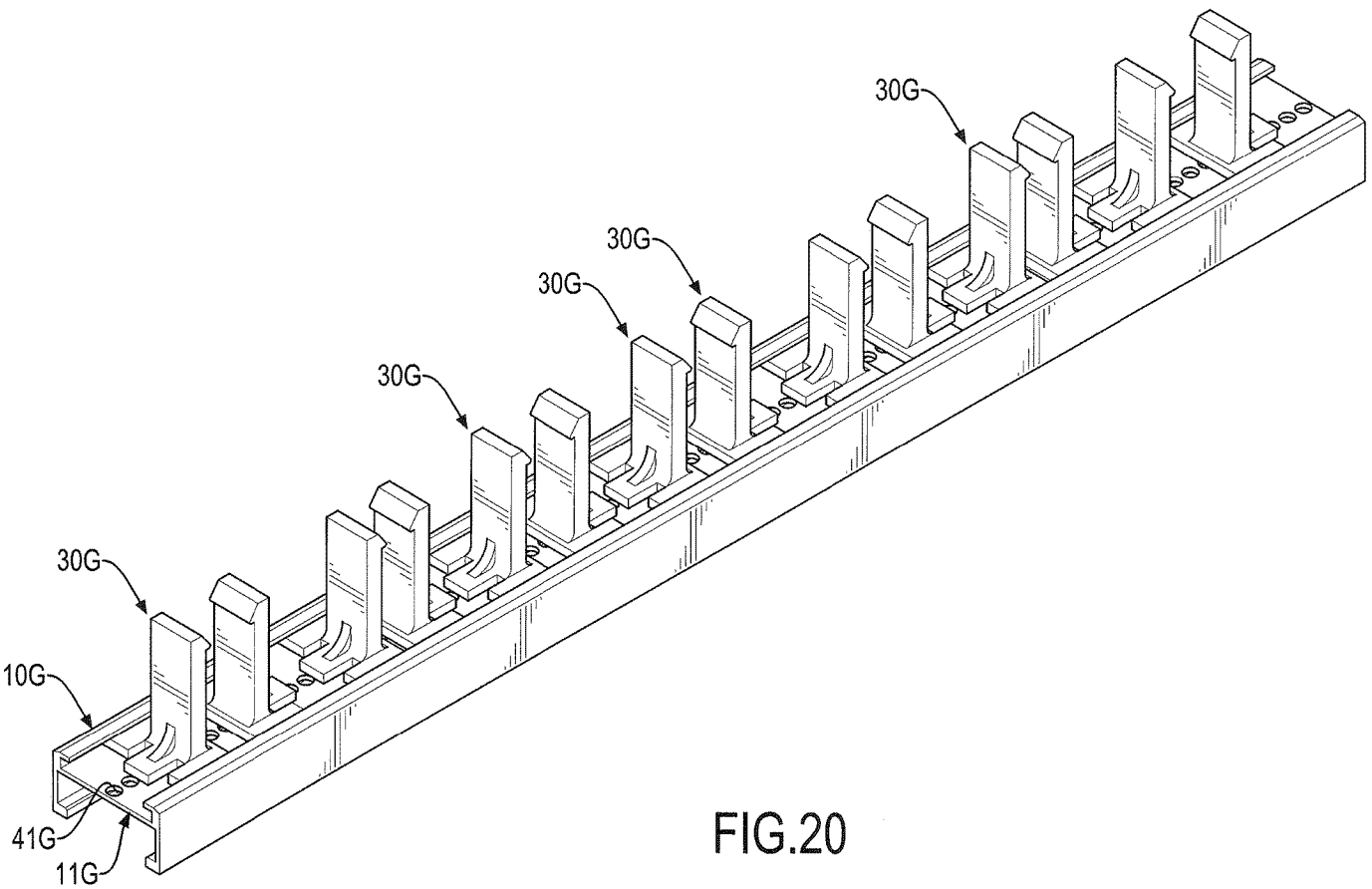
FIG. 20 is a perspective view of a seventh embodiment of a hand tool frame in accordance with the present invention.
Figure 21:
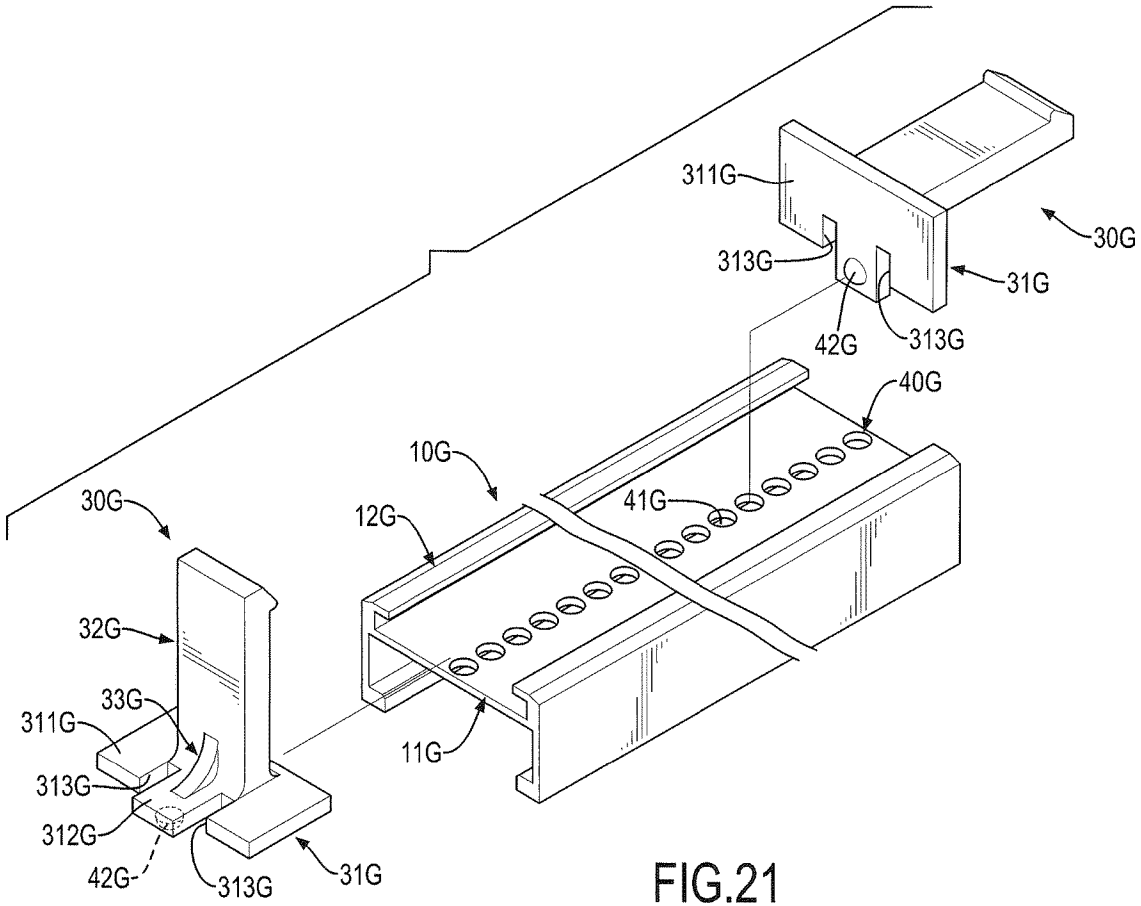
FIG. 21 is an exploded perspective view of the hand tool frame in FIG. 20.
Figures 22, 22A, 22B:
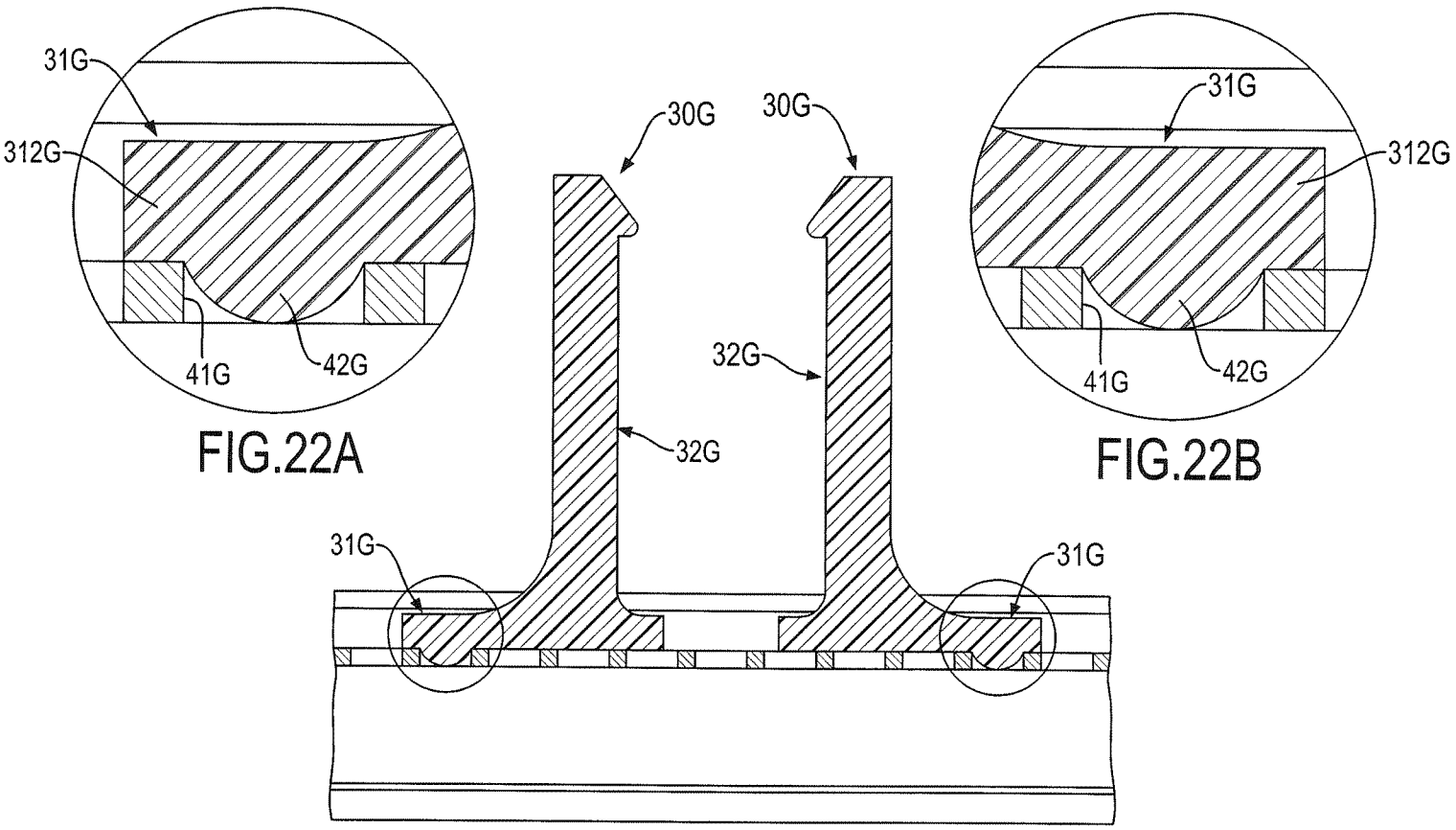
FIG. 22 is an enlarged side view in partial section of the hand tool frame in FIG. 20.
FIGS. 22A and 22B are enlarged cross sectional side views of the hand tool frame in FIG. 22.

Additionally, with reference to FIGS. 20 to 22, a seventh embodiment of a hand tool frame in accordance with the present invention is substantially the same as the second embodiment except for the following features. The seventh embodiment of the hand tool frame does not have a positioning board 20 that is disclosed in the second embodiment of the hand tool frame in the present invention, and the engaging structure 40G is formed between the track base 10G and the at least one pair of positioning mounts 30G.

The at least one first engaging segment 41G of the engaging structure 40G is deposited on the top surface of the bottom panel 11G. Furthermore, the engaging structure 40G has multiple first engaging segments 41G being positioning holes and formed through the top surface of the bottom panel 11G at spaced intervals. The first engaging segments 41G are aligned in a straight line and are preferably formed at the middle of the top surface of the bottom panel 11G at spaced intervals.

The at least one pair of positioning mounts 30G are slidably mounted on the track base 10G, and the sliding seat 31G of each one of the at least one pair of positioning mounts 30G has a body 311G, a positioning portion 312G, and two engaging slots 313G. The body 311G is U-shaped, is slidably mounted in slide rail 12G and has a bottom surface, a top surface, two free ends, and a middle segment. The bottom surface of the body 311G abuts the top surface of the bottom panel 11G. The middle segment of the body 311G is formed between the two free ends of the body 311G. The positioning portion 312G is formed on and protrudes from the middle segment of the body 311G and has a bottom surface and a top surface. The two engaging slots 313G are respectively formed through the body 311G between the free ends of the body 311G and the positioning portion 312G and this makes the positioning portion 312G elastomeric.

In addition, each one of the at least one pair of positioning mounts 30G has a supporting rib 33G formed on the top surface of the body 311G of the sliding seat 31G and an outer surface of the extending element 32G to enhance the connecting structural strength between the sliding seat 31G and the extending element 32G. With further reference to FIGS. 22A and 22B, the second engaging segment 42G of the engaging structure 40G is a positioning protrusion, is formed on and protrudes downwardly from the bottom surface of the positioning portion 312G, and selectively engages with one of the first engaging segment 41G on the bottom panel 11G. Then, the sliding seat 31G may be engaged with the track base 10G at a specific position.

Figure 23:
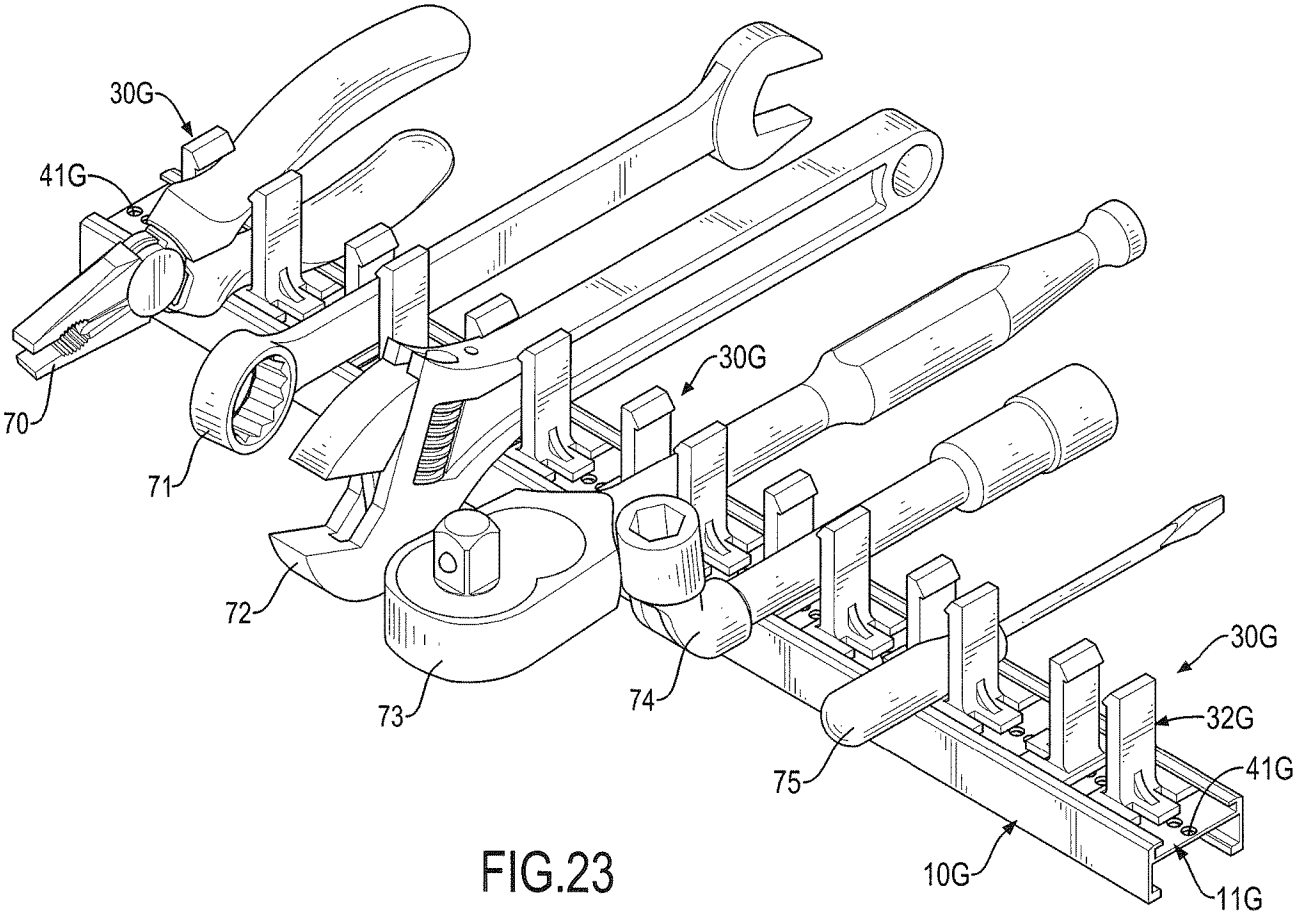
FIG. 23 is an operational perspective view of the hand tool frame in FIG. 20 showing pliers, combination spanners, adjustable wrenches, socket wrenches, hexagonal wrenches, and screwdrivers being mounted on the hand tool frame.
Figure 24:
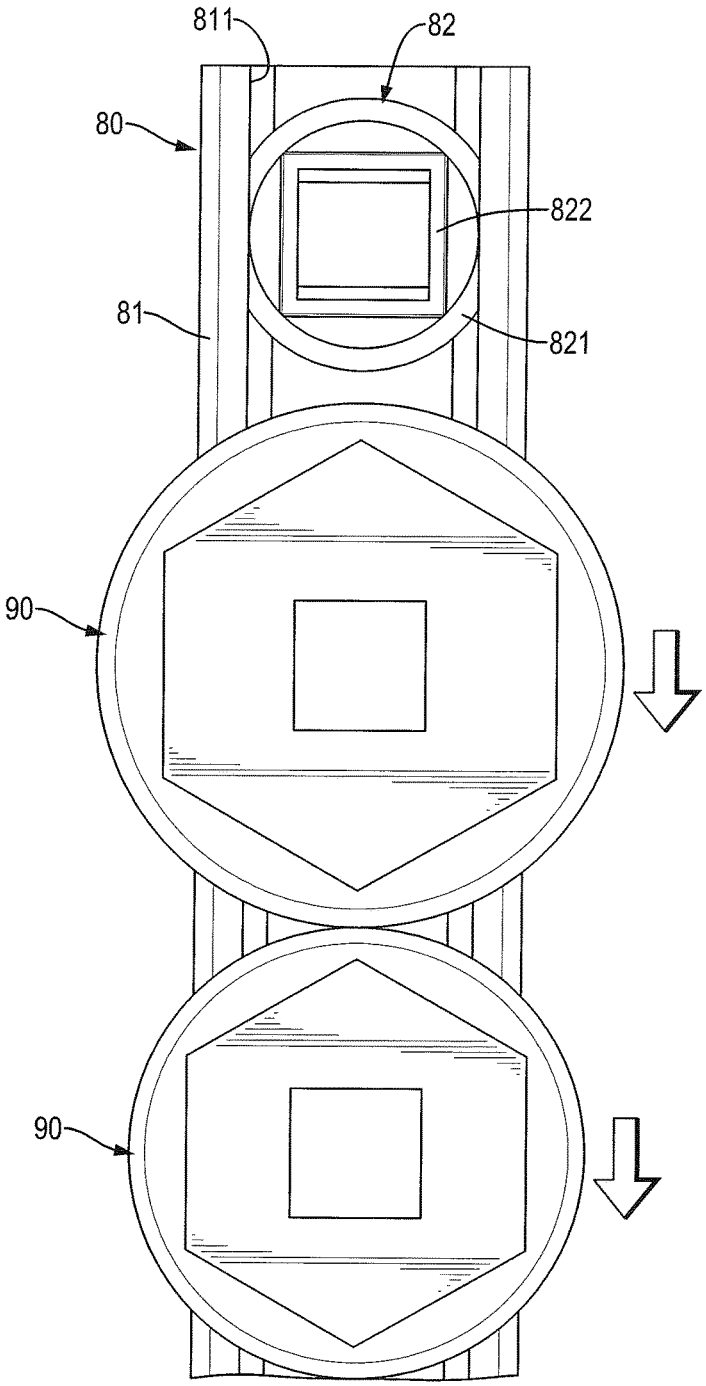
FIG.24 PRIOR ART
FIG. 24 is an enlarged and operational front side view of a hand tool frame in accordance with the prior art, shown with two sleeves mounted on the hand tool frame.
Figure 25:
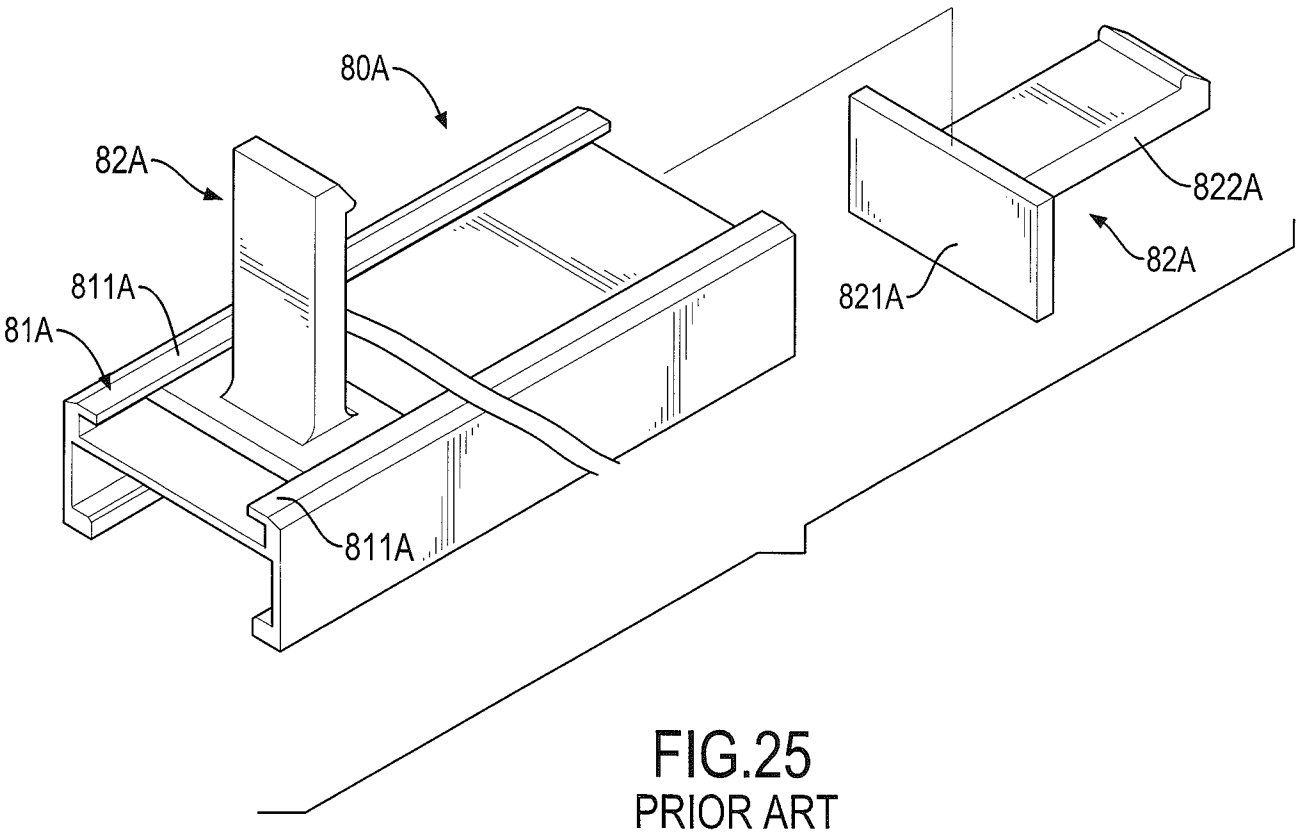
FIG.25 PRIOR ART
FIG. 25 is an enlarged and exploded perspective view of another hand tool frame in accordance with the prior art.
Figure 26:
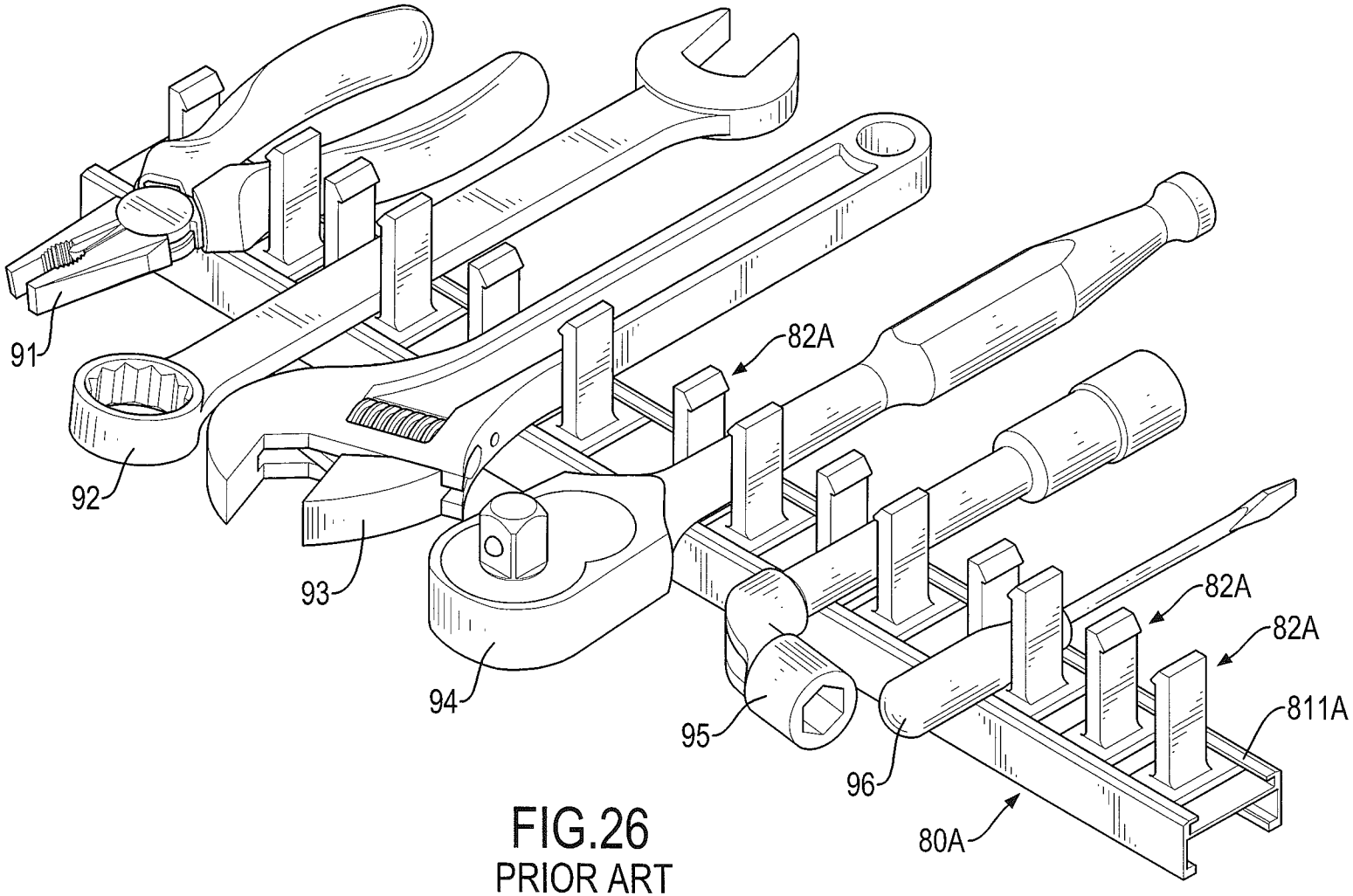
FIG.26 PRIOR ART
FIG. 26 is an operational perspective view of the hand tool frame in FIG. 25 showing pliers, combination spanners, adjustable wrenches, socket wrenches, hexagonal wrenches, and screwdrivers mounted on the hand tool frame.

With reference to FIG. 23, when the hand tool frame of the seventh embodiment in the present invention is in use, different kinds of hand tools such as pliers 70, combination spanners 71, adjustable wrenches 72, socket wrenches 73, hexagonal wrenches 74 or screwdrivers 75 may be inserted into the holding space that is formed between the extending elements 32G of the at least one pair of positioning mounts 30G. Furthermore, the holding space between the extending elements 32G of the at least one pair of positioning mounts 30G may be adjusted by moving the sliding seats 31G of the at least one pair of positioning mounts 30G along the multiple first engaging segments 41G relative to the track base 10G. After adjusting the holding space between the at least one pair of positioning mounts 30G, the at least one pair of positioning mounts 30G may be positioned on the bottom panel 11G by the engagement between the multiple second engaging segments 42G and the multiple first engaging segments 41G of the engaging structure 40G between the positioning mounts 30G and the track base 10G. Then, the different kinds of hand tools can be held securely on the track base 10G by the at least one pair of positioning mounts 30G, and this will improve the practicality of the hand tool frame.

What is claimed is:

1. A hand tool frame comprising:

a track base being elongated and having:

a bottom panel having:

a top surface; and a bottom surface;

a slide rail formed on and protruding from the top surface of the bottom panel and having:

a top side;

a top opening formed through the top side of the slide rail; and a sliding recess formed in the slide rail between the top side of the slide rail and the top surface of the bottom panel and communicating with the top opening;

at least one positioning mount slidably mounted on the track base along two opposite longitudinal directions of the track base, with each positioning mount having:

a sliding seat slidably mounted in the sliding recess of the slide rail and having:

a bottom side;

a top side facing the top opening of the slide rail; and an extending element formed on and protruding upwardly from the top side of the sliding seat and extending out of the slide rail via the top opening;

a positioning board located on the track base, with the positioning board including a top surface elastic toward the sliding recess, with the sliding recess located intermediate the positioning board and the top side of the slide rail; and an engaging structure formed between the positioning board and the at least one positioning mount to enable the at least one positioning mount to position securely on the positioning board without sliding relative to the track base, with the engaging structure having:

multiple first engaging segments deposited on the top surface of the positioning board at spaced intervals and aligned in a straight line; and at least one second engaging segment deposited on the bottom side of the sliding seat of the at least one positioning mount, and selectively engaging with the one of the multiple first engaging segments to hold the at least one positioning mount securely on the track base without sliding relative to the track base.

2. The hand tool frame as claimed in claim 1, wherein the multiple first engaging segments are formed at a middle of the top surface of the bottom panel.

3. The hand tool frame as claimed in claim 2, wherein each one of the multiple first engaging segments is a curved engaging slot, and wherein each second engaging segment is an engaging ring.

4. A hand tool frame comprising:

a track base being elongated and having:

a bottom panel having:

a top surface; and a bottom surface;

a slide rail formed on and protruding from the top surface of the bottom panel and having:

a top side;

a top opening formed through the top side of the slide rail; and a sliding recess formed in the slide rail between the top side of the slide rail and the top surface of the bottom panel and communicating with the top opening;

at least one positioning mount slidably mounted on the track base, with each positioning mount having:

a sliding seat slidably mounted in the sliding recess of the slide rail and having:

a bottom side;

a top side facing the top opening of the slide rail; and an extending element formed on and protruding upwardly from the top side of the sliding seat and extending out of the slide rail via the top opening; and an engaging structure formed between the track base and the at least one positioning mount to enable the at least one positioning mount to position securely on the track base without sliding relative to the track base, with the engaging structure having:

multiple first engaging segments deposited relative to the track base at spaced intervals and aligned in a straight line; and at least one second engaging segment deposited on the bottom side of the sliding seat of the at least one positioning mount, and selectively engaging with the one of the multiple first engaging segments to hold the at least one positioning mount securely on the track base without sliding relative to the track base, wherein each one of the multiple first engaging segments is a curved engaging slot, and wherein each second engaging segment is an engaging ring.

5. The hand tool frame as claimed in claim 2, wherein:

the at least one positioning mount comprises at least one pair of positioning mounts;

the extending element of each one of the at least one pair of positioning mounts is a clamping arm and is formed on the sliding seat; and the sliding seat of each one of the at least one pair of positioning mounts has:

a body being U-shaped, slidably mounted in slide rail and having:

a bottom surface abutting the top surface of the bottom panel;

a top surface;

two free ends; and a middle segment formed between the two free ends of the body;

a positioning portion formed on and protruding from the middle segment of the body and having:

a bottom surface; and a top surface; and two engaging slots respectively formed through the body between the two free ends of the body and the positioning portion.

6. The hand tool frame as claimed in claim 5, wherein:

the multiple first engaging segments are positioning holes and are formed through the top surface of the bottom panel at spaced intervals; and the at least one second engaging segment of the engaging structure is a positioning protrusion, is formed on and protrudes downwardly from the bottom surface of the positioning portion, and selectively engages with one of the multiple first engaging segments on the bottom panel.

7. The hand tool frame as claimed in claim 5, wherein each one of the at least one pair of positioning mounts has a supporting rib formed on the top surface of the body of the sliding seat and an outer surface of the extending element to enhance the connecting structural strength between the sliding seat and the extending element.

8. The hand tool frame as claimed in claim 6, wherein each one of the at least one pair of positioning mounts has a supporting rib formed on the top surface of the body of the sliding seat and an outer surface of the extending element to enhance the connecting structural strength between the sliding seat and the extending element.

9. The hand tool frame as claimed in claim 1, wherein the at least one positioning mount is slidably and rotatably mounted on the track base.

10. The hand tool frame as claimed in claim 1, wherein the track base further has a connecting track, with the positioning board mounted in the track base, with the bottom panel separating the slide rail and the connecting track, with the bottom panel including a communicating opening, and with the positioning board exposed through the communicating opening.

11. The hand tool frame as claimed in claim 10, wherein the positioning board includes two rail bars and a through recess located at a rear surface between the two rail bars, wherein the front surface at a middle of the positioning board corresponding to the through recess extends into the communicating recess.

12. The hand tool frame as claimed in claim 11, wherein the at least one positioning mount is slidably and rotatably mounted on the track base.

13. The hand tool frame as claimed in claim 4, wherein the at least one positioning mount is slidably and rotatably mounted on the track base.

* * * * *